United States Patent [19]

Moen

[11] 4,310,323

[45] Jan. 12, 1982

[54] METHOD OF MANUFACTURE OF H-DIVIDER CONTAINERS

[76] Inventor: Lenard E. Moen, 7914 Michigan Ave., Whittier, Calif. 90602

[21] Appl. No.: 157,375

[22] Filed: Jun. 9, 1980

Related U.S. Application Data

[62] Division of Ser. No. 910,198, May 30, 1978, Pat. No. 4,220,076.

[51] Int. Cl.[3] ..... B31B 7/26

[52] U.S. Cl. ..... 493/92; 493/89; 493/456; 493/457; 493/912

[58] Field of Search ..... 493/92, 90, 98, 99, 493/89, 912, 168, 169, 447, 449, 457, 456, 455, 162

[56] References Cited

U.S. PATENT DOCUMENTS

| | | | |
|---|---|---|---|
| 3,134,308 | 5/1964 | Ali-Oglu | 493/92 |
| 3,605,572 | 9/1971 | Derderian | 493/912 X |
| 3,673,928 | 7/1972 | Striplin | 493/114 X |
| 3,952,634 | 4/1976 | Rollins et al. | 493/171 |
| 3,965,804 | 6/1976 | Elford | 493/168 |
| 4,154,148 | 5/1979 | Weremiczyk et al. | 493/90 |

*Primary Examiner*—James F. Coan
*Attorney, Agent, or Firm*—Frederick E. Mueller

[57] ABSTRACT

A process and machine for making a corrugated or fibre board two-piece H-divider container in a single cycle of operation comprising erecting and gluing the H-blank upon itself and then erecting and gluing the body blank therearound. The vertical divider panels of the H-piece are folded at the bottom along a hinge line that includes two spaced crush score line areas interrupting a slit score line.

8 Claims, 59 Drawing Figures

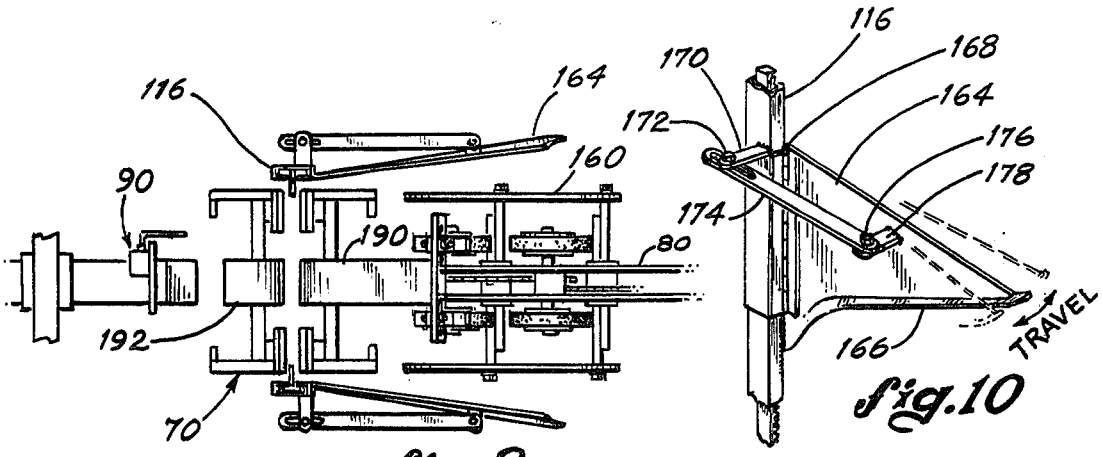
fig.8
fig.10
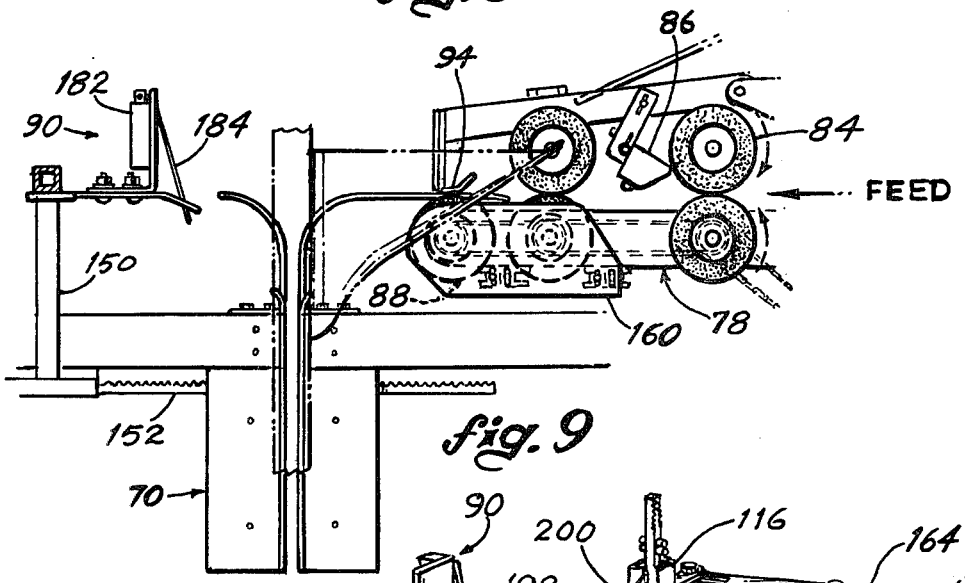
fig. 9
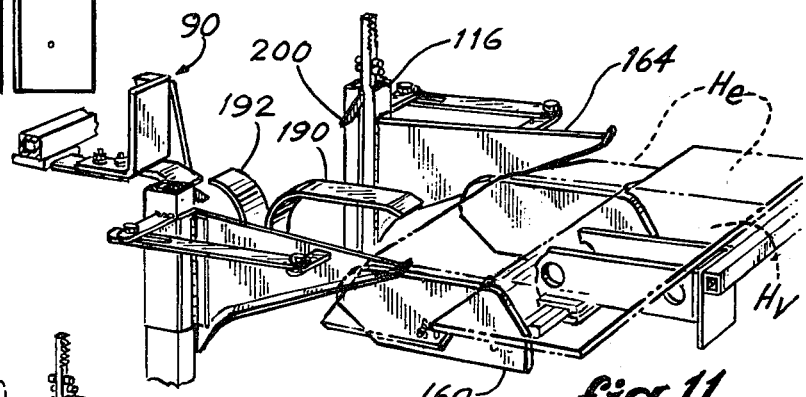
fig.11
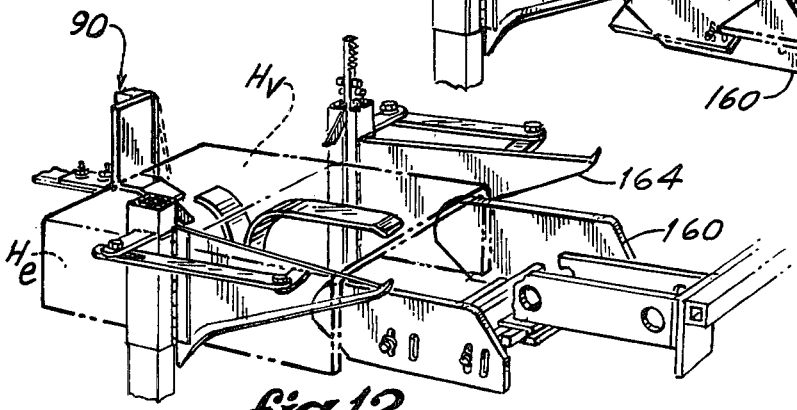
fig.12

722
390
732
734
N.O.
N.C.
392
714
N.O.
N.C.
184
182
712
TRAVEL
300
298
204
256
268
736
296
684
294
264
TRAVEL
200
650
724
694
692
730
696
752
666
664
340a
750
690
686
668
352
486
688
740
430
452
344a
70
450
DIE COMPRESSION
INTERMEDIATE POSITION
RETRACTED
728
710
706
708
754
726
704
700
702
742
GLUE SYSTEM
746
720
670
716
718
674
H
B
80
742
62
676
680
678
SUPPLY
AIR PRESSURE
82
719
64
682
672

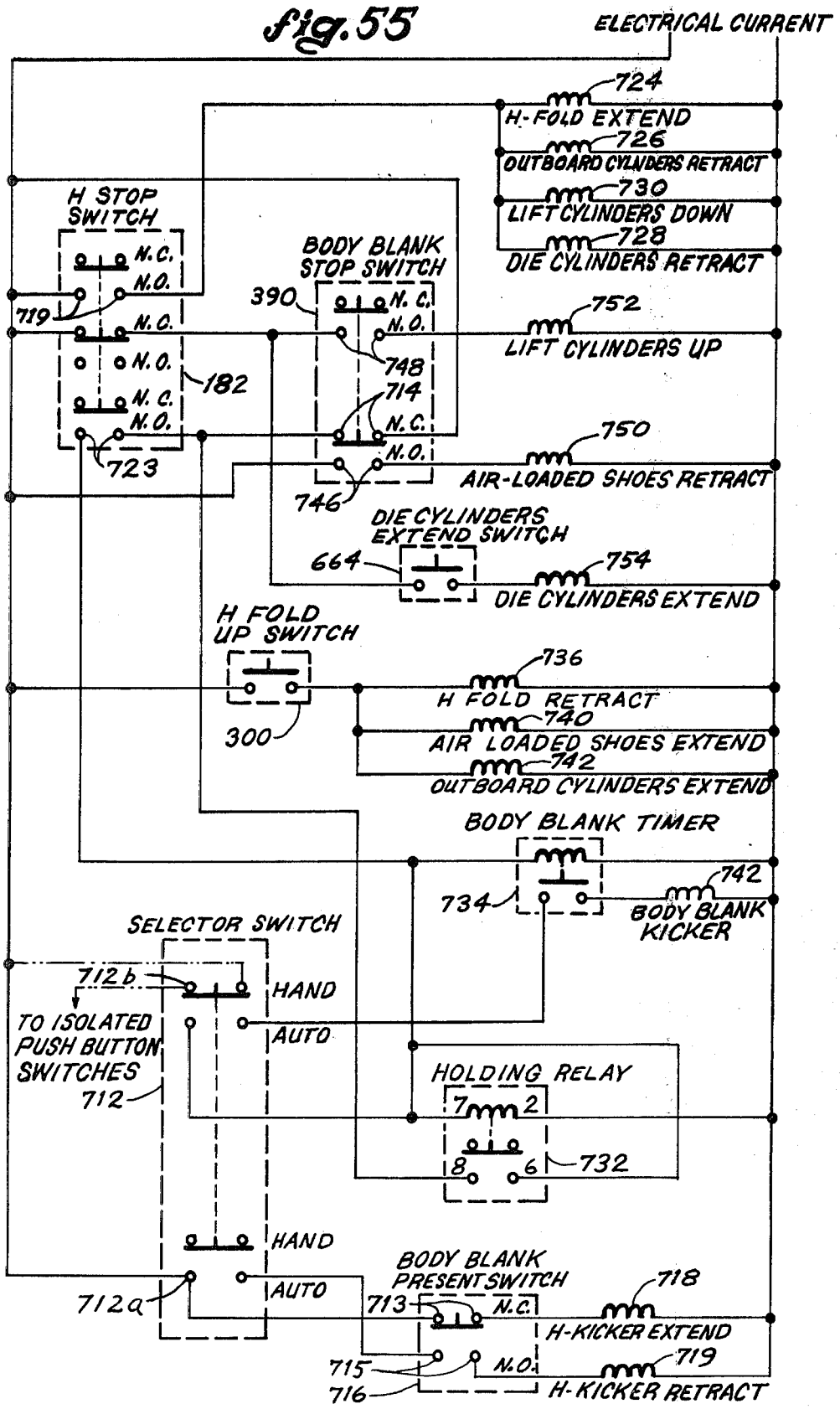
fig. 55
ELECTRICAL CURRENT
724
H-FOLD EXTEND
726
OUTBOARD CYLINDERS RETRACT
730
LIFT CYLINDERS DOWN
728
DIE CYLINDERS RETRACT
H STOP SWITCH
N.C.
N.O.
719
N.C.
N.O.
N.C.
N.O.
182
723
BODY BLANK STOP SWITCH
390
N.C.
N.O.
748
714
N.C.
N.O.
746
752
LIFT CYLINDERS UP
750
AIR-LOADED SHOES RETRACT
DIE CYLINDERS EXTEND SWITCH
664
754
DIE CYLINDERS EXTEND
H FOLD UP SWITCH
300
736
H FOLD RETRACT
740
AIR LOADED SHOES EXTEND
742
OUTBOARD CYLINDERS EXTEND
BODY BLANK TIMER
734
742
BODY BLANK KICKER
SELECTOR SWITCH
712b
HAND
AUTO
TO ISOLATED PUSH BUTTON SWITCHES
712
HOLDING RELAY
7
2
8
6
732
HAND
AUTO
712a
BODY BLANK PRESENT SWITCH
713
N.C.
N.O.
718
H-KICKER EXTEND
715
716
719
H-KICKER RETRACT

METHOD OF MANUFACTURE OF H-DIVIDER CONTAINERS

REFERENCE TO RELATED APPLICATION

This is a divisional application of pending prior application Ser. No. 910,198 filed on May 30, 1978 and now U.S. Pat. No. 4,220,076.

BACKGROUND OF THE INVENTION

This invention relates to the manufacture of H-divider containers and, more particularly, to an improved container geometry and a single cycle method and machine for making H-divider containers. A number of methods and machines are known in the prior art for manufacturing a variety of containers of the type which are divided into cellular spaces. These include, for example, the following U.S. Patents: Derderian U.S. Pat. No. 3,605,572, Richardson et al. U.S. Pat. No. 2,879,700, Roda U.S. Pat. No. 3,780,627, Russell U.S. Pat. No. 3,396,896, Frankenstein U.S. Pat. No. 2,837,982, Forrer U.S. Pat. No. 3,397,623, Randle, Jr. U.S. Pat. No. 3,921,893, and Lovett et al. U.S. Pat. No. 3,225,665. However, insofar as I am aware, it is unknown in the prior art to manufacture a two-piece H-divider container in a single cycle of operation out of two flat blanks.

SUMMARY OF THE INVENTION

The H-divider container is made of two flat pieces, namely, a body blank and an H-divider blank. The latter is slit and scored to define two divider panel areas, each of which is flanked by integral end wall panel areas. A transverse fold or hinge line joining the divider panel areas is defined in part by a slit score line leaving the top liner intact, the hinge at opposite ends spaced inwardly also including a pair of crush score line areas interrupting the slit score.

The end panel areas of the flat H-blank are turned downwardly substantially 90° relative to the divider panel areas in transit from a supply hopper to an indexed position in the machine. A pair of H-divider feed fingers then descend to engage the top liner of the H-blank on the two crush score areas of the hinge line. During downward movement of the H-divider piece, die means of the machine effect reverse folding of the divider panel areas upwardly, and 90° rotation of the end wall areas, to insert the fully erected H-piece into a split mandrel. In response to this insertion, a previously formed and completed container is ejected from the mandrel onto a conveyor system. One of the H-divider vertical panel areas having been preglued, the split mandrel is now compressed to effect adhesive fastening of the vertical panel areas, after which the split mandrel is expanded to retain the erected H-piece relatively loosely therein.

The fully glued and erected H-piece projects slightly beneath the bottom face of the mandrel with the end panel areas exposed in readiness to have marginal flaps of the body blank glued thereagainst along the bottom edge and vertical edges. In movement to an indexed position in the machine the body blank has glue beads applied to marginal flaps thereof. A body blank folding and die plate mechanism of the machine effects raising of the body blank into contact with the exposed lower edge of the H-piece and then against the bottom face of the mandrel. Thereafter, the body blank folding and die means effect folding of its side wall areas after which die plate portions of the body blank folding and die plate mechanism are compressed to effect final folding and gluing of the marginal flaps of the body blank against the end wall areas of the H-piece. The split mandrel means and body blank folding and die mechanisms are so related to one another that centering of the fully formed H-piece relative to the bottom panel area of the body blank is achieved during upward folding of the side wall portions of the body blank.

The mechanical elements of the machine are pneumatically powered and electromechanically controlled in a manner to minimize lost motion and lost time within a cycle of operation.

FIG. *2a* is a bottom view of an H-blank with a portion cut away to show its cut, slit and press type scores.

Figures 1, 2, 2A, 3A, 3B, 3C:
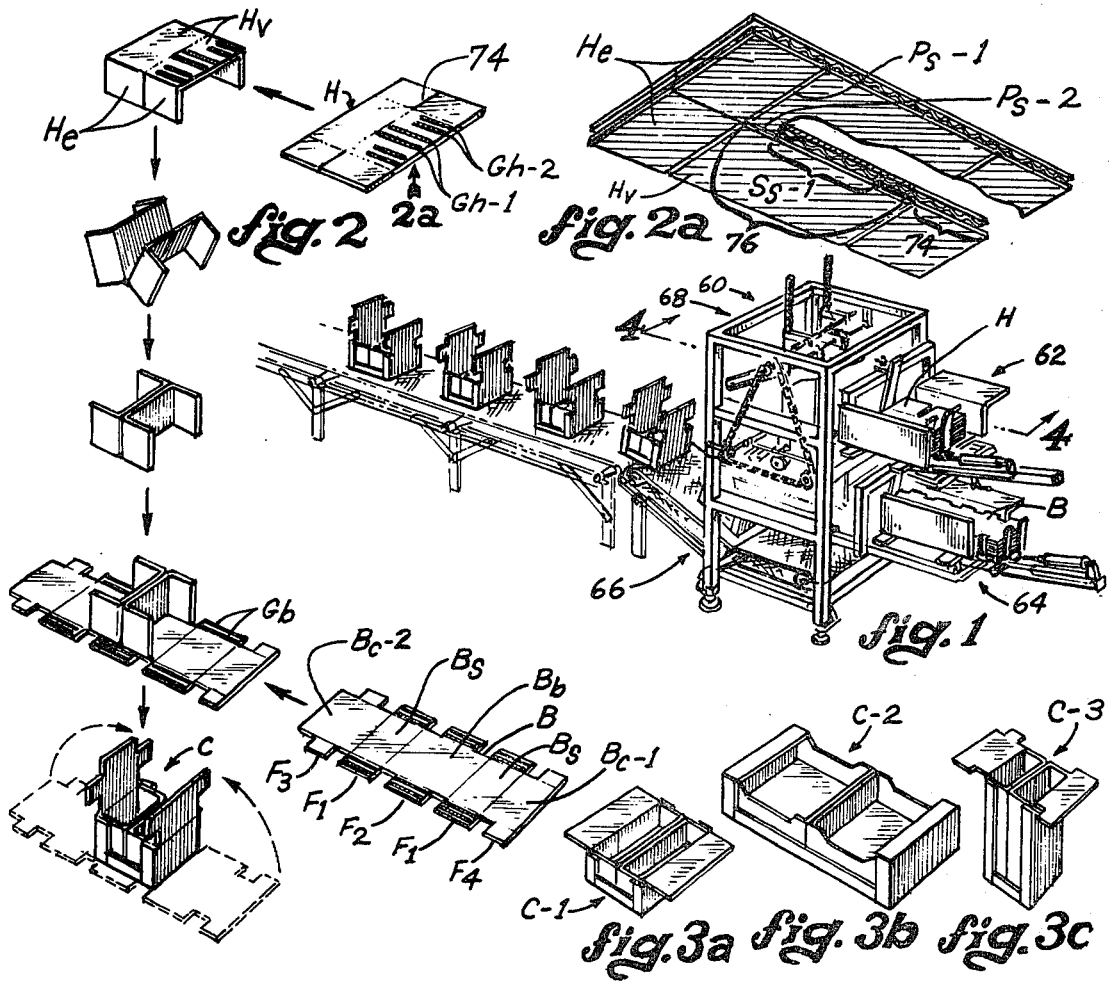
FIG. 1 is a perspective view of a box making machine embodying the invention.
FIG. 2 is a schematic flow diagram of steps in the process of making an H-divider container from an H-blank and a body blank.

FIGS. *3a*, *3b*, and *3c* are perspective views of different sizes and styles of H-containers produceable by the machine of FIG. 1.

Figure 4:
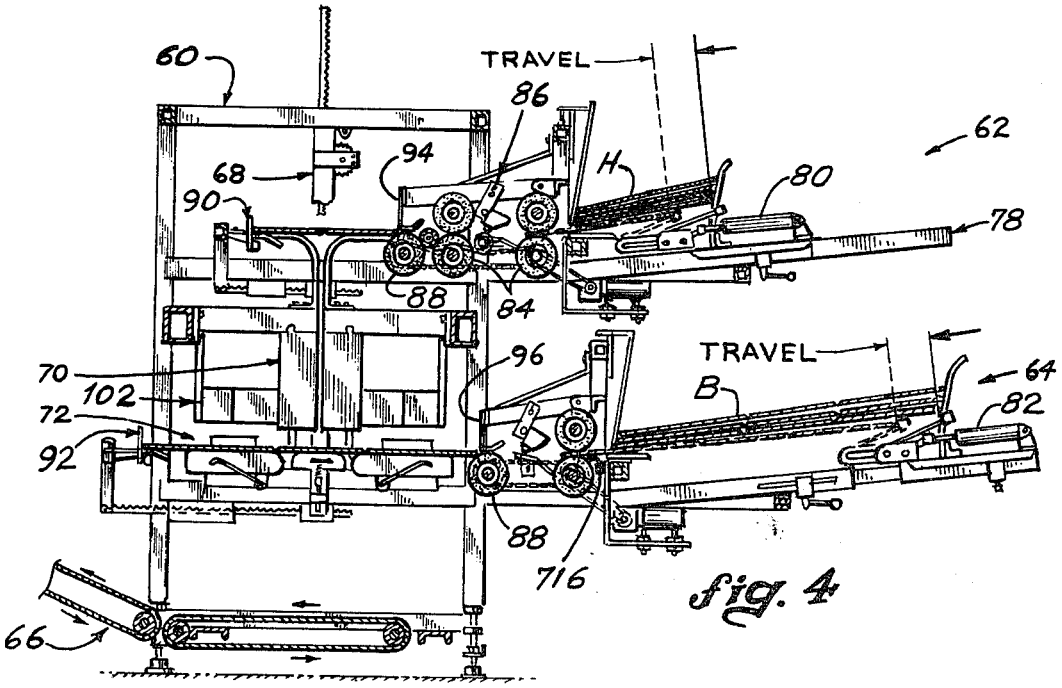

FIG. 4 is a somewhat schematic vertical section, taken on the line 4—4 of FIG. 1, illustrating the means of delivery of the flat H-blank and flat body blank into flat indexed positions in the box making machine.

Figure 5:
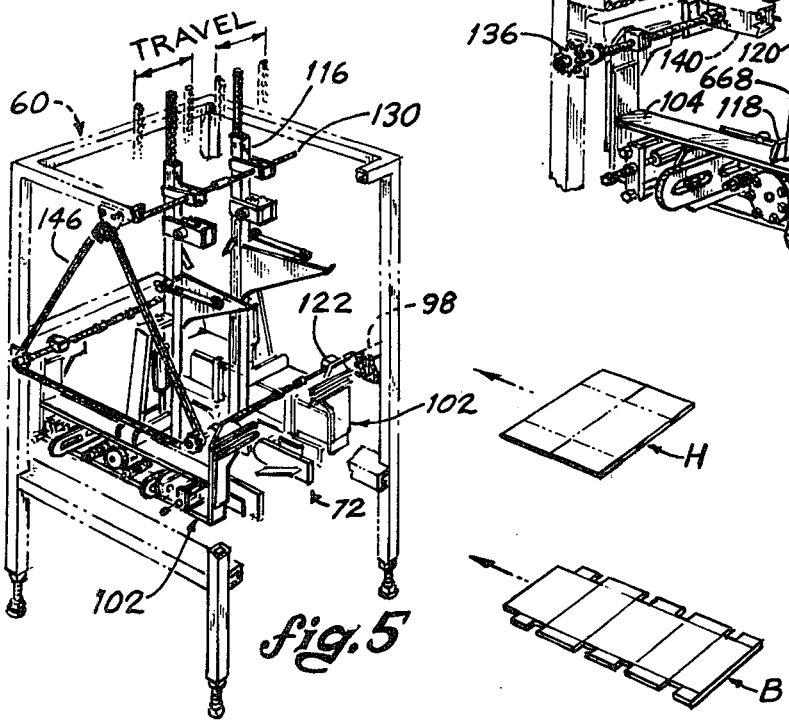

FIG. 5 is a partial perspective view, of the common adjusting means of the H-fold blank and the body blank fold mechanisms of the machine of FIG. 1, the machine frame being shown in phantom line to show its relationship to the fold mechanisms.

Figure 6:
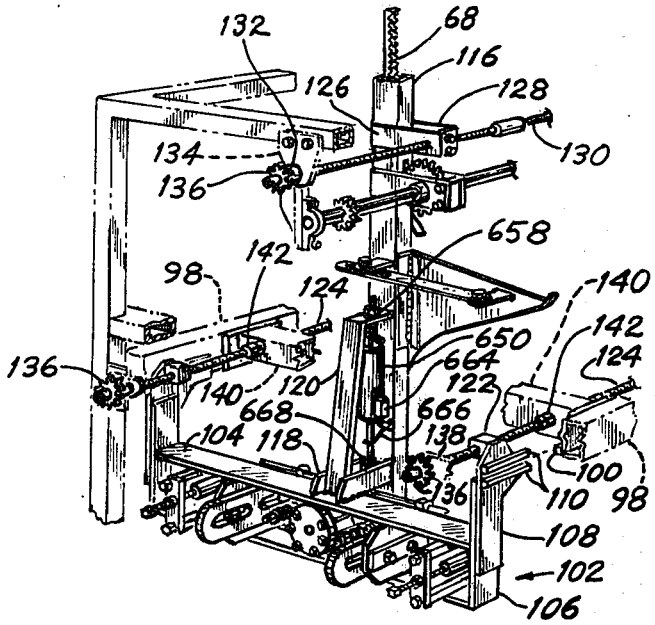

FIG. 6 is a partial perspective view of one side of the mechanisms shown in FIG. 5, on a larger scale.

Figure 7:
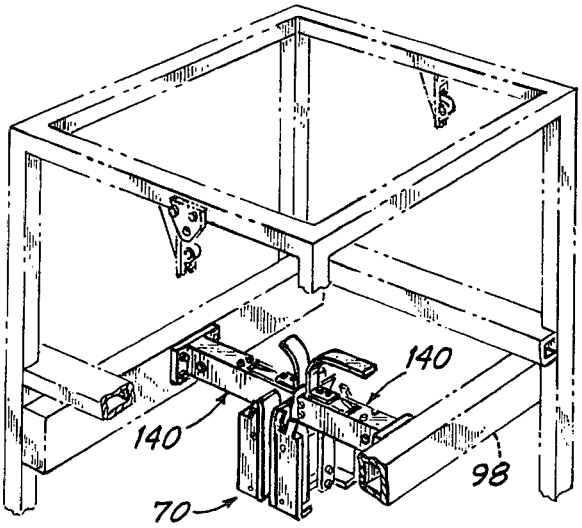

FIG. 7 is a perspective view of the mandrel halves illustrating the manner of their connection to the machine frame, the latter being shown in phantom outline.

FIG. 8 is a partial top plan view, particularly illustrating the support and fold shoes for the H-blank.

FIG. 9 is a partial vertical elevation of the H-fold mechanism of FIG. 8.

FIG. 10 is a partial perspective view of one of the H-fold shoes of FIG. 8 particularly illustrating an adjustment feature thereof.

FIGS. 11 and 12 are similar partial perspective views of the H-fold machanism of FIGS. 8–10 illustrating, in phantom outline, a pair of steps in the sequence of folding of the H-blank.

Figure 13:
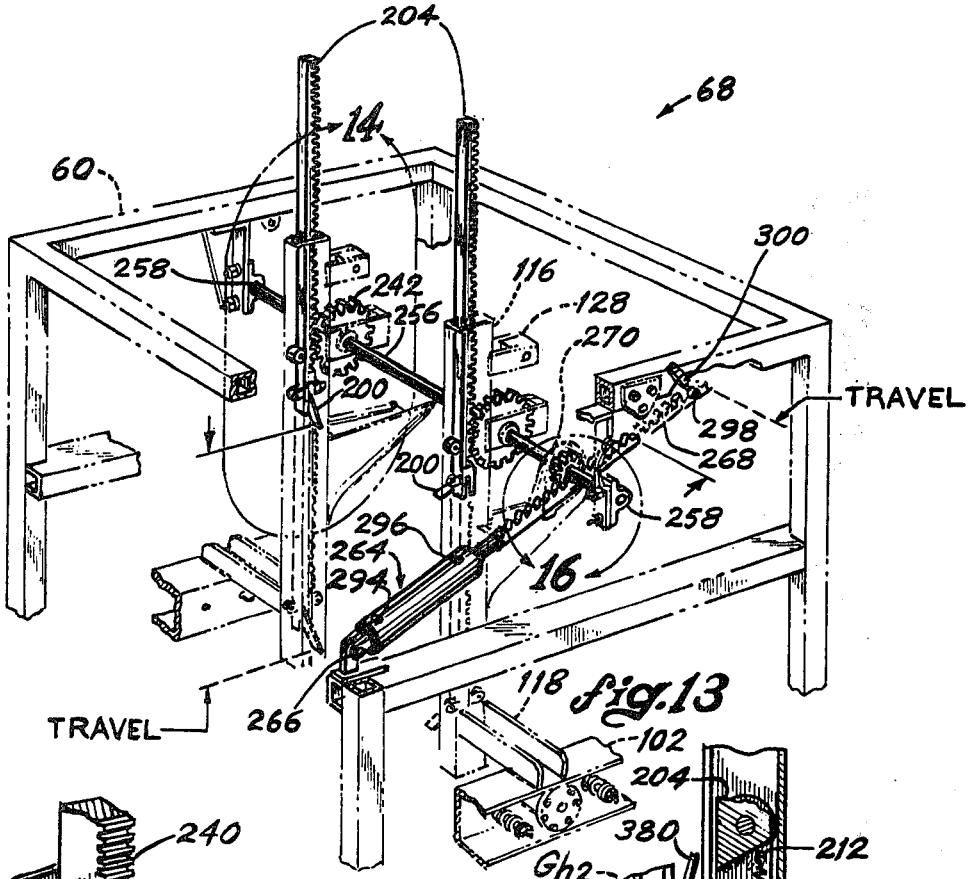

FIG. 13 is a partial perspective view of the mechanism for driving the folding fingers for the H-blank, with portions cut away and illustrating in phantom outline for clarity.

Figure 14:
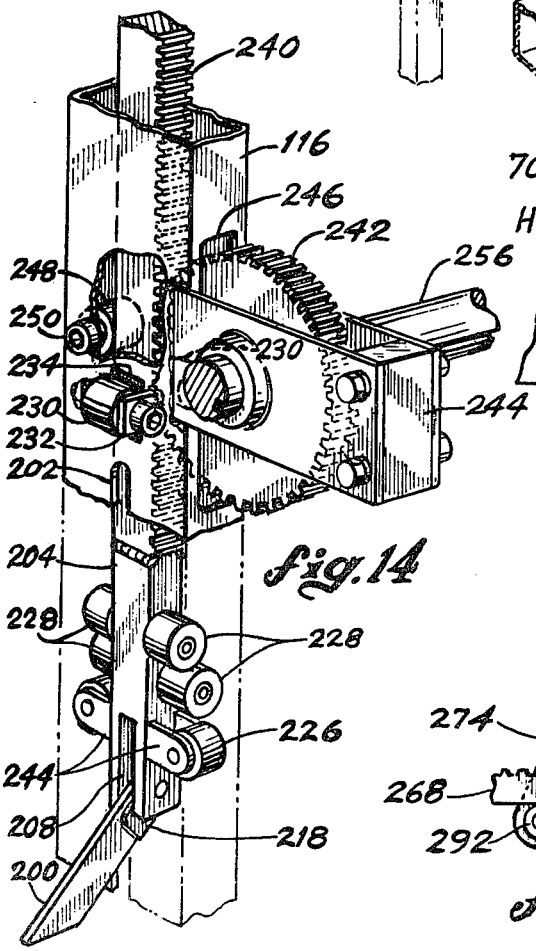

FIG. 14 is a partial perspective view, on a larger scale, of a portion of the drive mechanism of FIG. 13.

Figure 15:
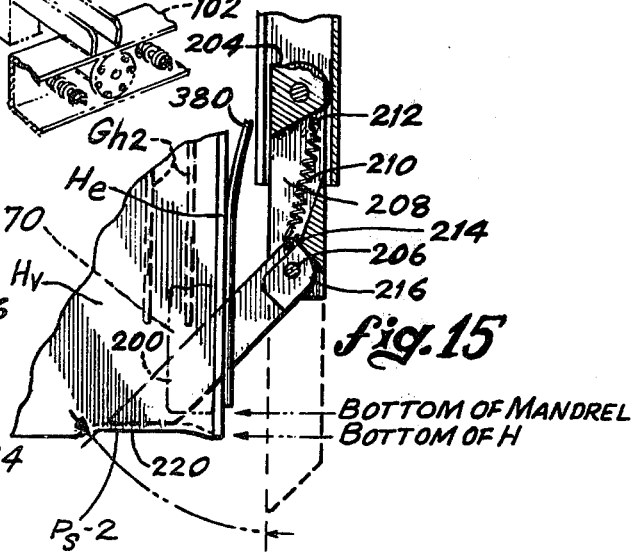

FIG. 15 is a partial vertical section of one of the fold fingers in driving engagement with a crush score line area of the transverse fold line of the H-blank.

Figure 16:
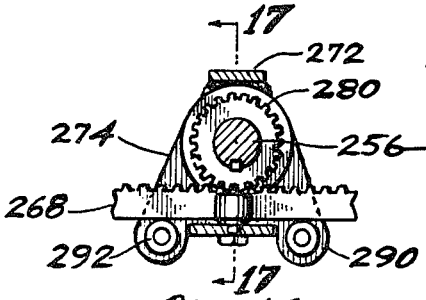
Figure 17:
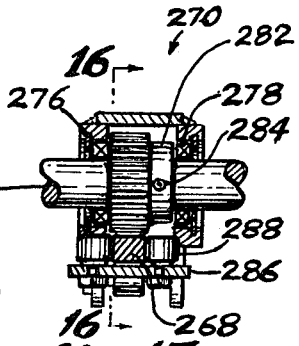

FIG. 16 is a sectional view of a bearing mechanism in the finger drive means, in the area 16 of FIG. 13, and taken on the line 16—16 of FIG. 17.

FIG. 17 is a sectional view on the line 17—17 of FIG. 16.

Figure 18:
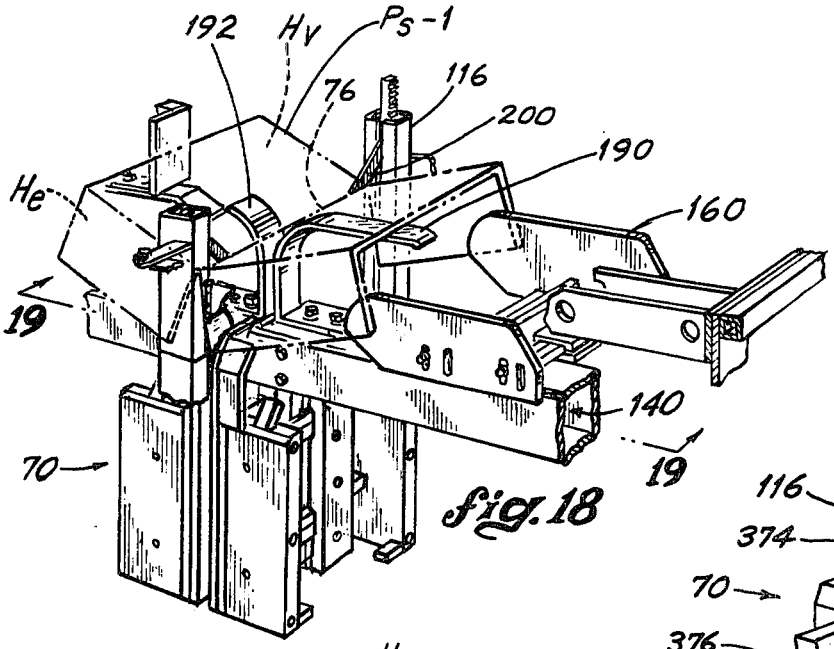

FIG. 18 is a partial perspective view of a portion of the H-fold mechanism and, in phantom outline, of an H-blank in a corresponding partially folded condition.

Figure 19:
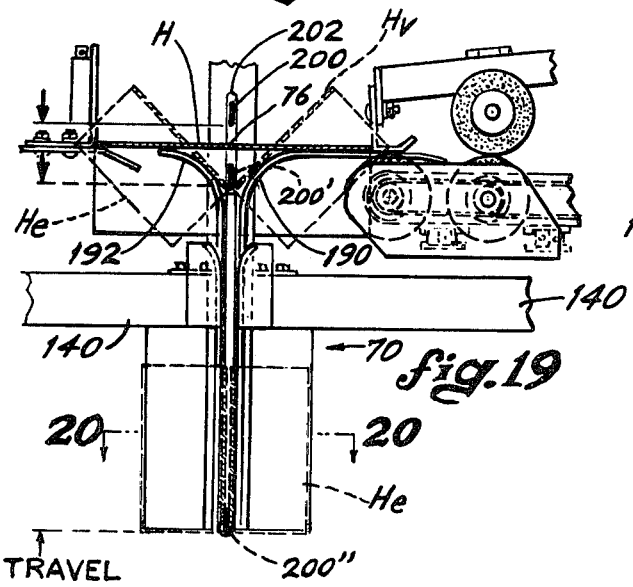

FIG. 19 is a somewhat schematic vertical section of the mechanism of FIG. 18 with an H-blank in a flat indexed position and, in phantom outline, of H-blanks in partially folded and fully folded positions corresponding to two phantom outline positions of the folding fingers or fold fingers.

Figure 20:
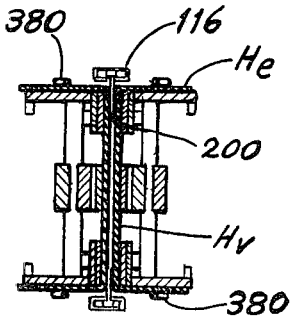

FIG. 20 is a partial horizontal section on the line 20—20 of FIG. 19.

Figure 21:
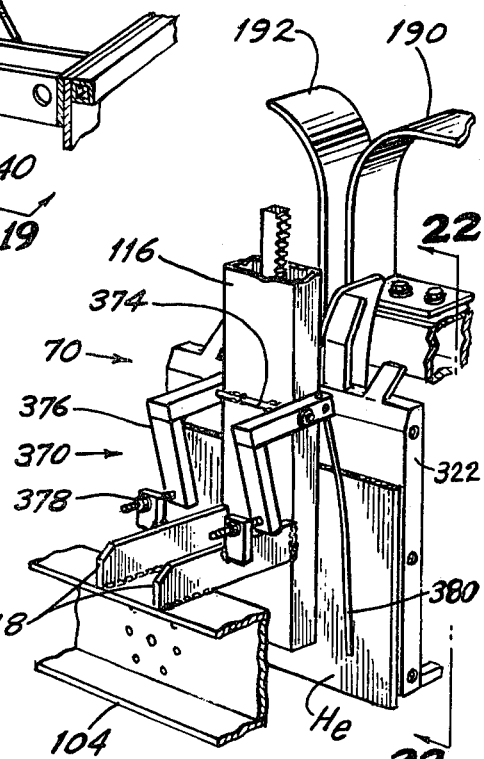

FIG. 21 is a partial perspective view, on a larger scale, of a portion of the mechanism on one side of FIG. 18.

Figure 22:
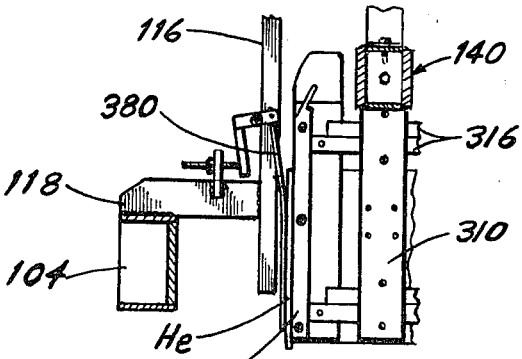

FIG. 22 is a partial vertical sectional view on the line 22—22 of FIG. 21.

Figure 23:
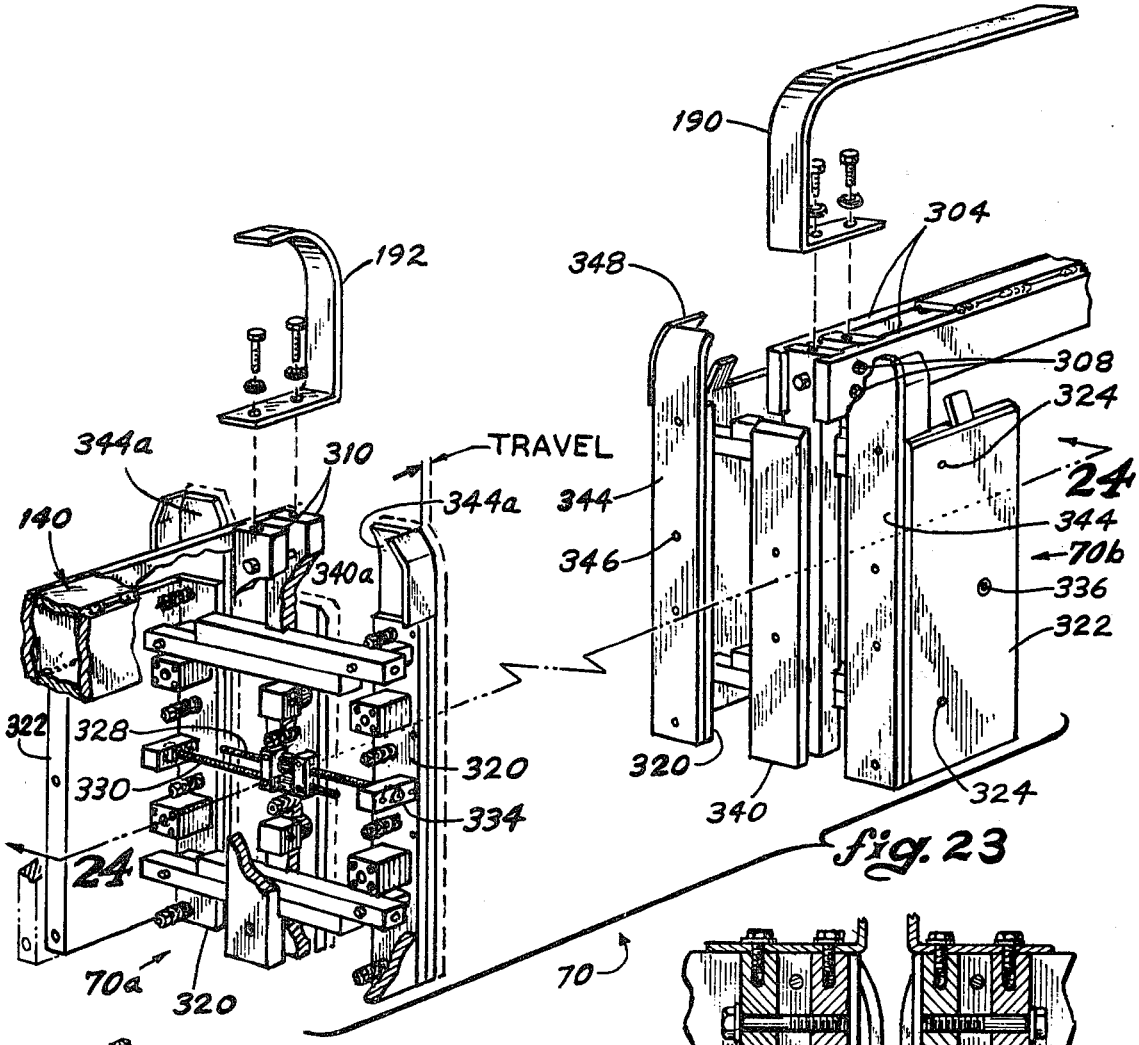

FIG. 23 is an exploded partial perspective view of the two mandrel halves.

Figure 24:
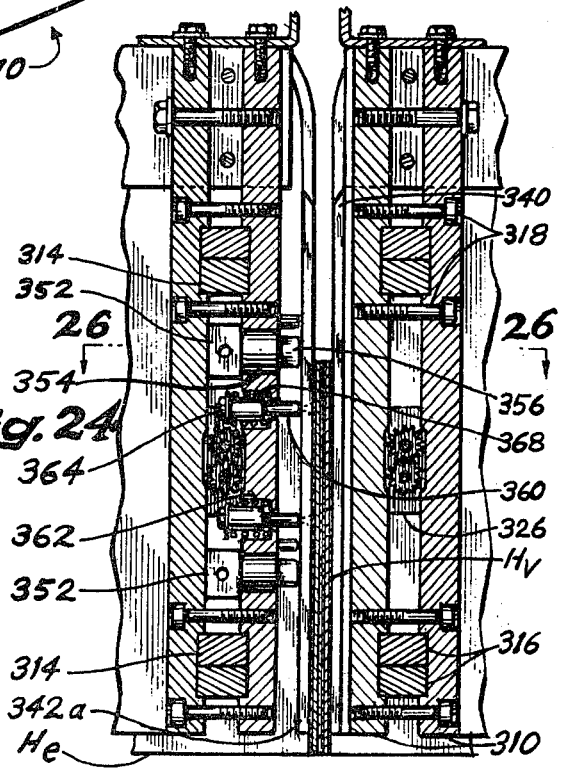

FIG. 24 is a partial vertical section of the mandrel assembly on the line 24—24 of FIG. 23 but with the mandrel halves spaced in a normal working relationship.

Figure 25:
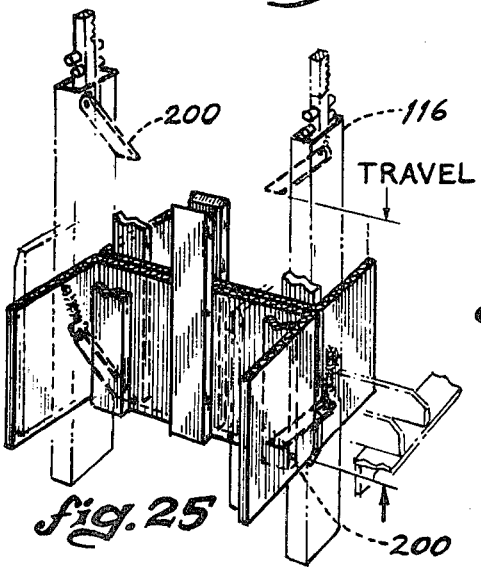

FIG. 25 is a perspective view of a fully folded and glued H-divider and, in phantom outline, of the fold fingers in two different positions of travel.

Figure 26:
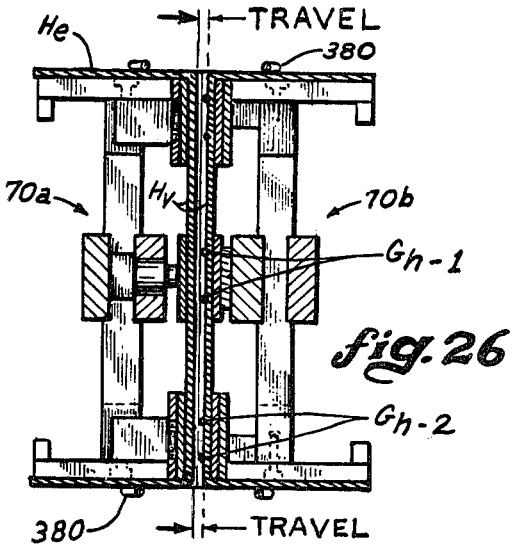

FIG. 26 is a horizontal section taken on the line 26—26 of FIG. 24 but showing the normal retracted spatial separation of the two mandrel halves just prior to compression through a stroke to compress the glue joint of the H-divider.

Figure 26A:
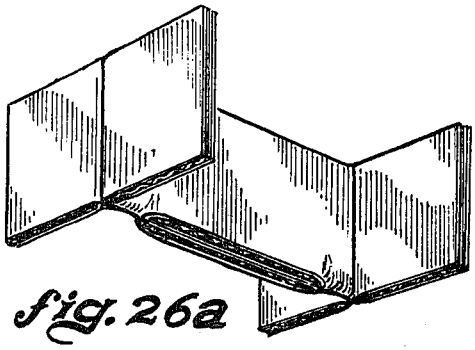

FIG. 26*a* is a perspective view of a fully folded and glued H-divider.

Figure 27:
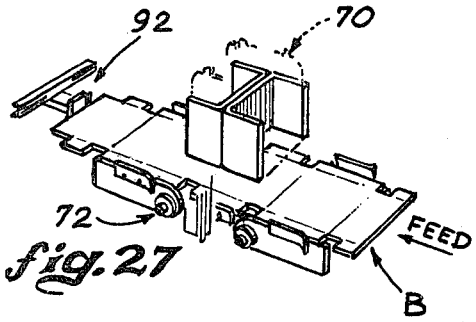

FIG. 27 is a schematic perspective view of a fully formed H-divider relative to an unformed flat body blank supported on the body blank fold and die plate mechanisms.

Figure 28:
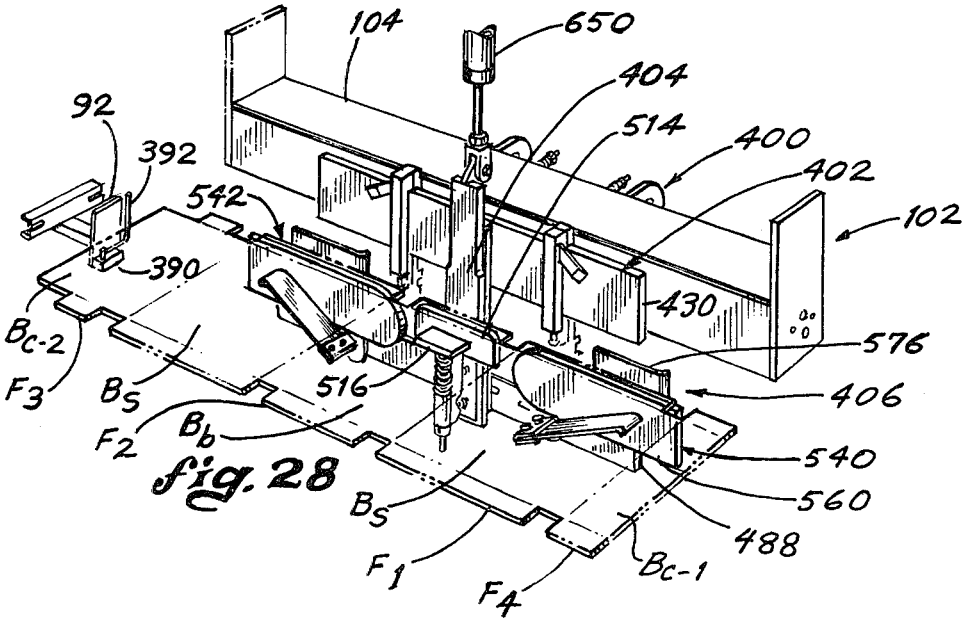

FIG. 28 is a schematic perspective view of one side of the body blank fold and die plate mechanisms and, in phantom outline, of the flat indexed position of the body blank relative thereto.

Figure 29:
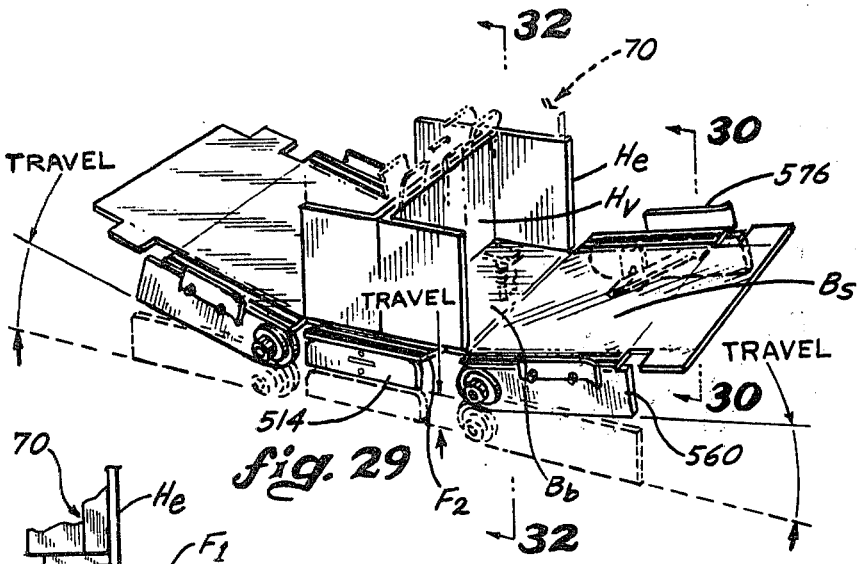

FIG. 29, in solid outline, is a schematic perspective view of a body blank being folded about a fully formed H-divider by the body blank folding mechanism, the folding mechanism also being shown in phantom outline in a lower flat unfolded condition.

Figure 30:
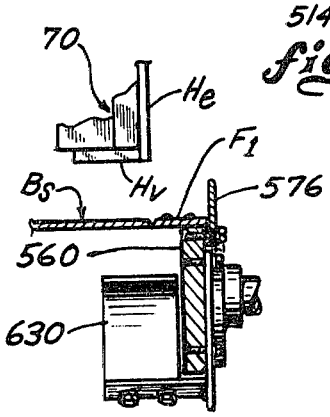
Figure 31:
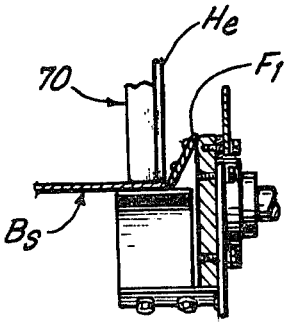

FIGS. 30 and 31 are partial sectional views of portions of the mandrel and body blank folding mechanism in two different positions relative to one another to illustrate the manner of folding of vertical end flaps of the H-blank around corresponding edges of the H-divider.

Figure 32:
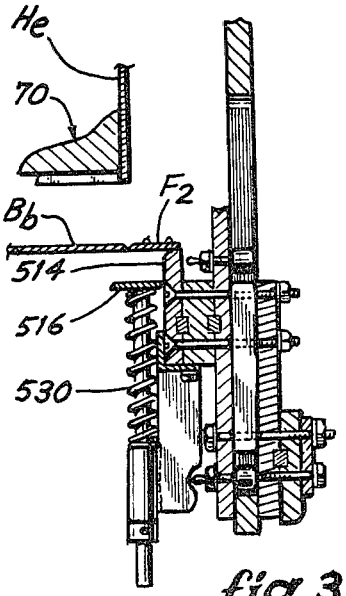
Figure 33:
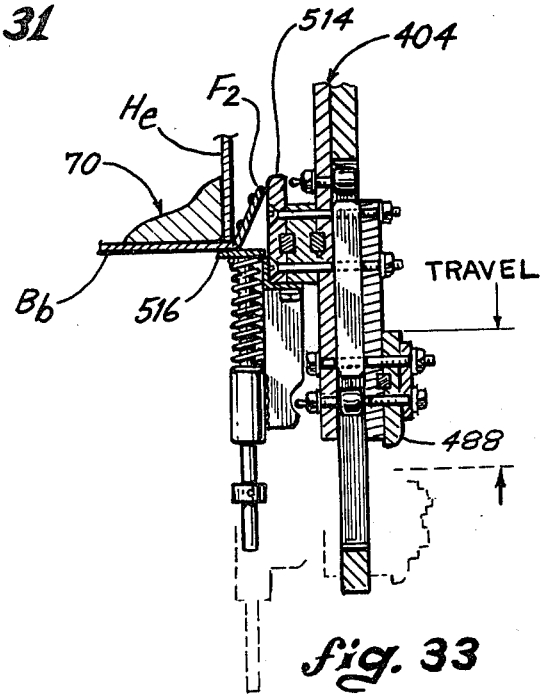

FIGS. 32 and 33 are partial sectional views of portions of the mandrel and body blank folding mechanism in different relative positions to illustrate the manner of folding horizontal flaps of the body blank around corresponding lower edges of the H-divider end panels.

Figure 34:
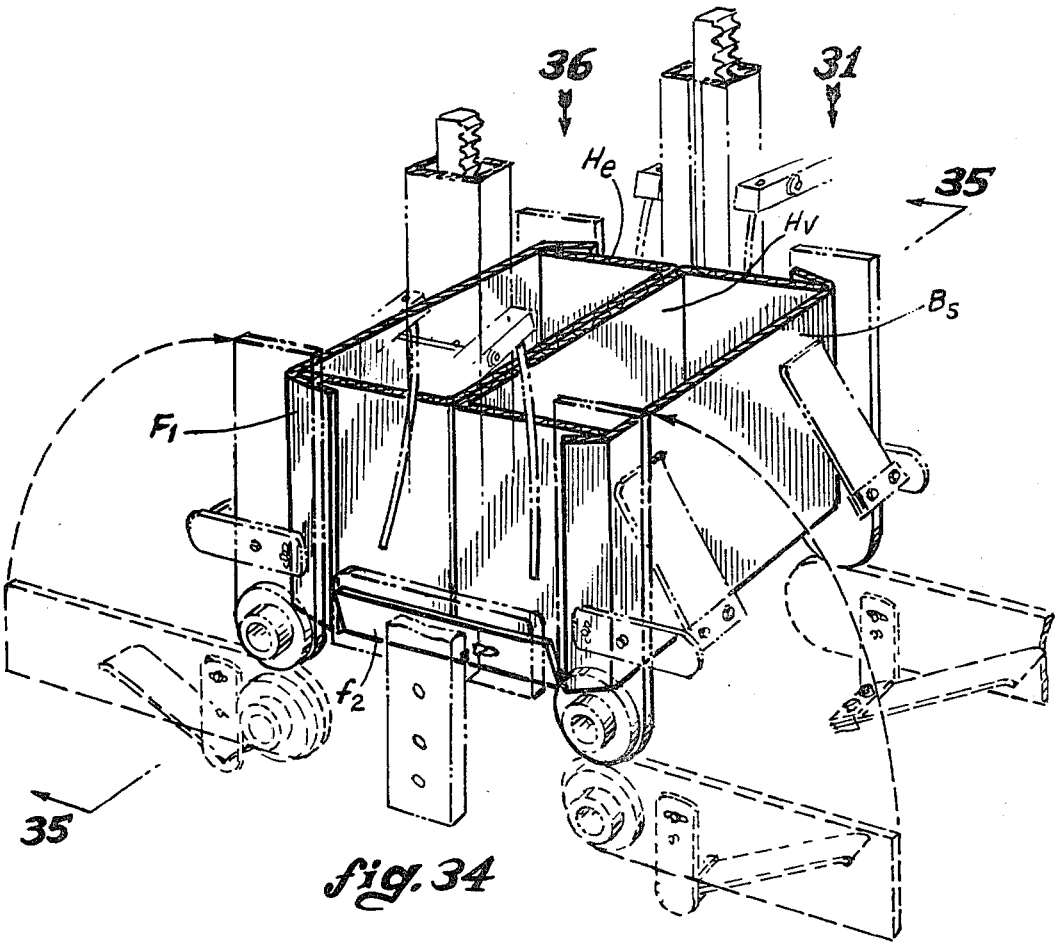

FIG. 34 is a perspective view in solid outline of a body blank fully erected around an H-divider and, in phantom outline, of two differently articulated positions of the body blank fold and die plate mechanism.

Figure 35:
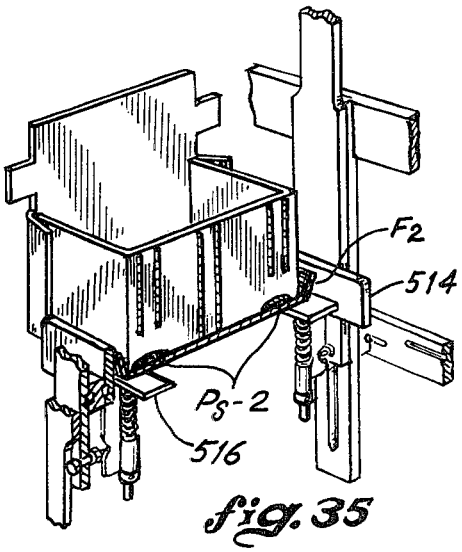

FIG. 35 is a transverse vertical sectional view on the line 35—35 of FIG. 34.

Figure 36:
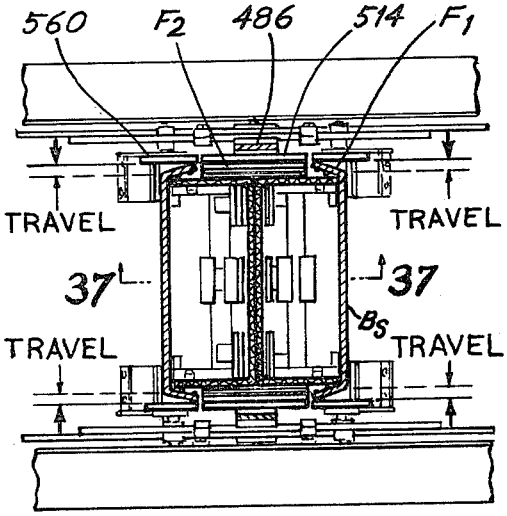

FIG. 36 is a partial top plan view taken in the direction of the arrow 36 of FIG. 34.

Figure 37:
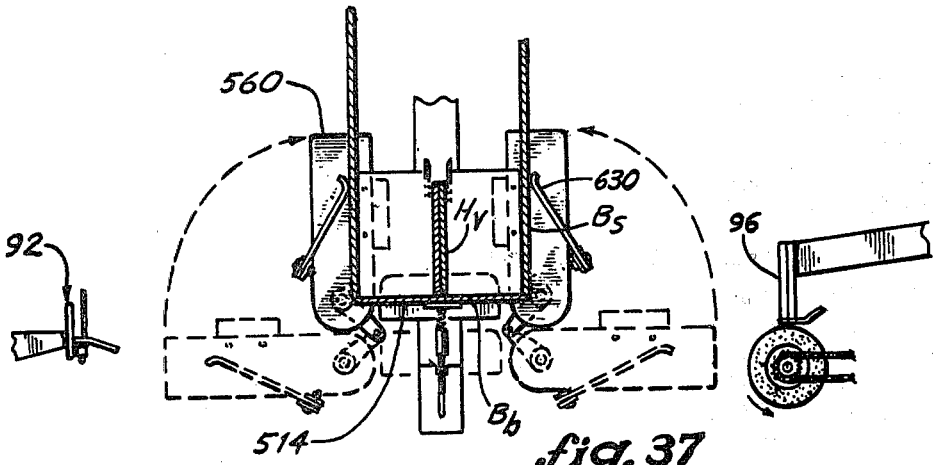

FIG. 37 is a schematic longitudinal vertical section through the mandrel and fully raised body blank folding mechanism and, in phantom outline, the fully lowered position of the body blank fold means.

Figure 38:
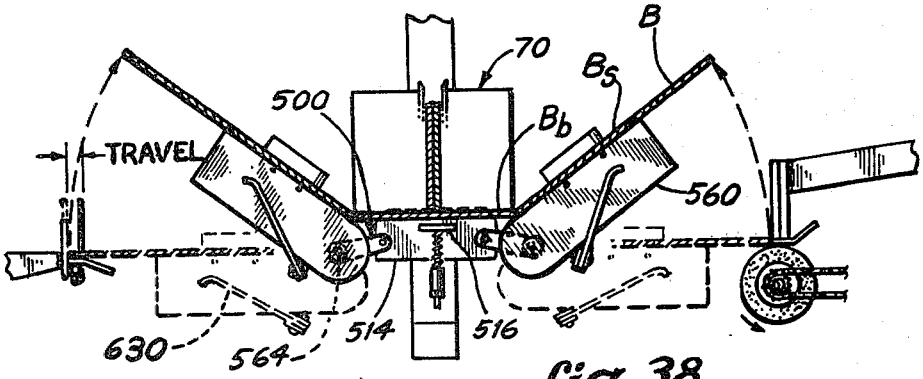

FIG. 38 is a view like FIG. 37 but showing the articulated folded position of the body blank folding means resulting from the initial increment of vertical translation thereof to raise the body blank up to the H-divider and mandrel.

Figure 39:
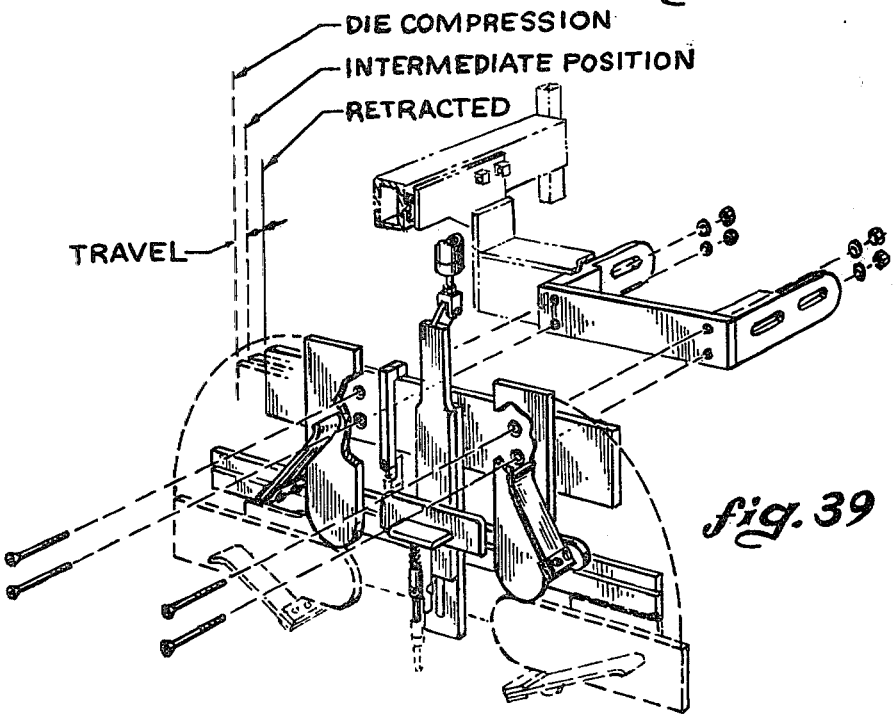

FIG. 39 is an exploded perspective view of one of the opposite pair of body blank folding mechanisms in relative positions of the components thereof corresponding to FIG. 37 and, in phantom outline, of a portion of the supporting machine framework.

Figure 40:
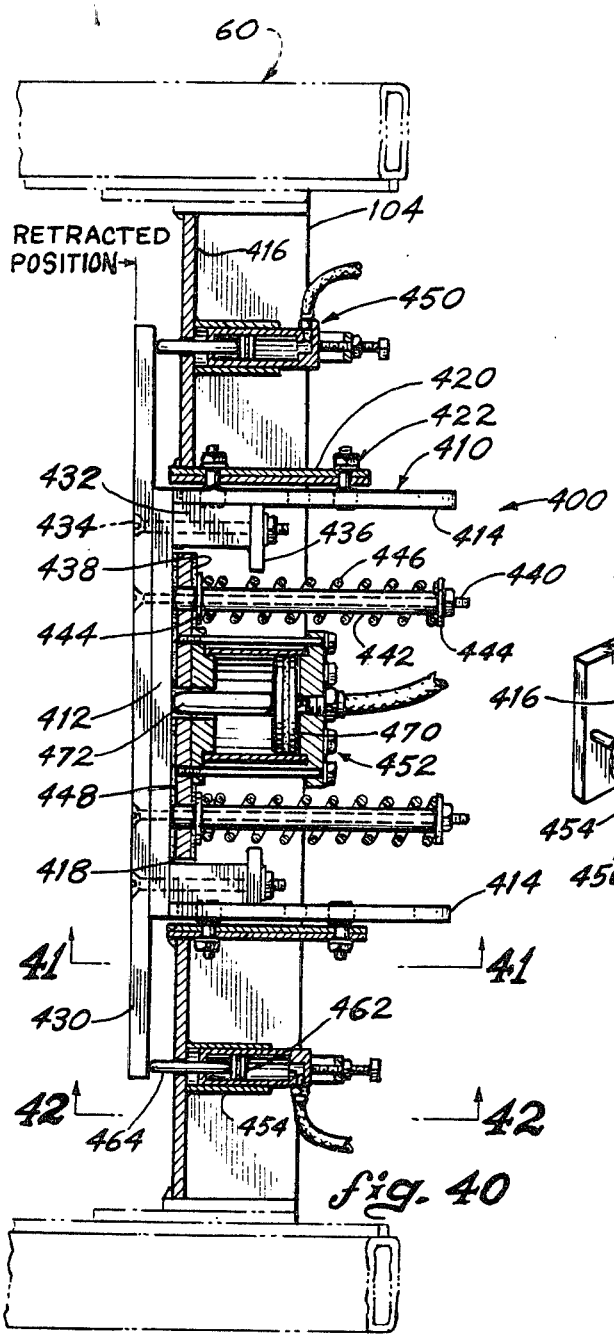

FIG. 40 is a horizontal sectional view of the support means for the body blank folding mechanism in fully retracted position, portions of the machine framework being in phantom outline.

Figure 41:
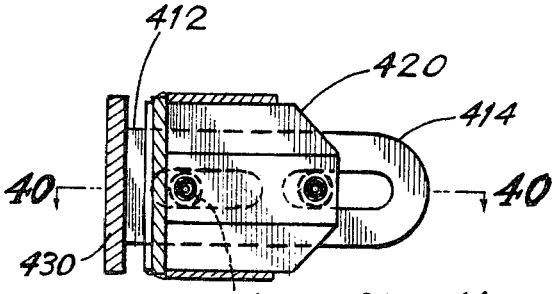

FIG. 41 is a sectional view on the line 41—41 of FIG. 40.

Figure 42:
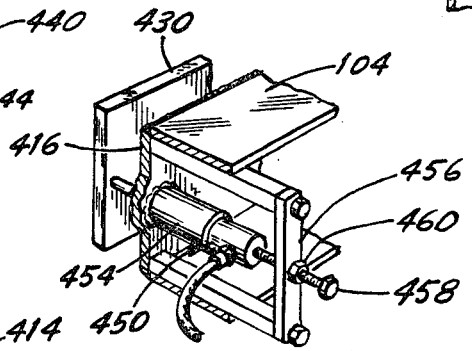

FIG. 42 is a partial cut-away perspective view illustrating a power means for moving the die plate means to an intermediate position.

Figure 43:
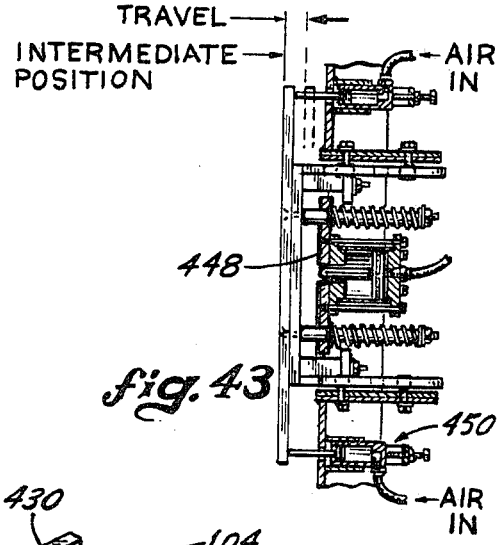

FIG. 43 is a schematic horizontal section similar to FIG. 40 but on a smaller scale illustrating the intermediate position of the die plate support means.

Figure 44:
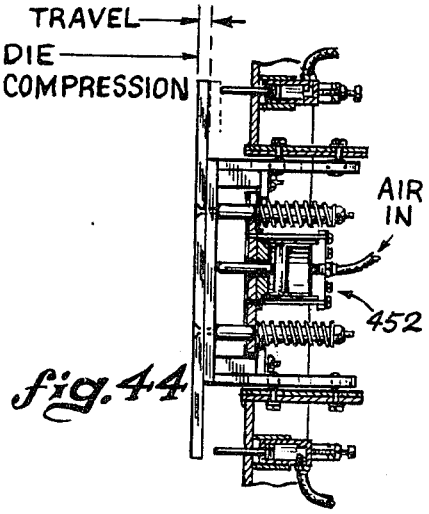

FIG. 44 is a view similar to FIG. 43 illustrating the die plate support means in a fully extended die compression position.

Figure 45:
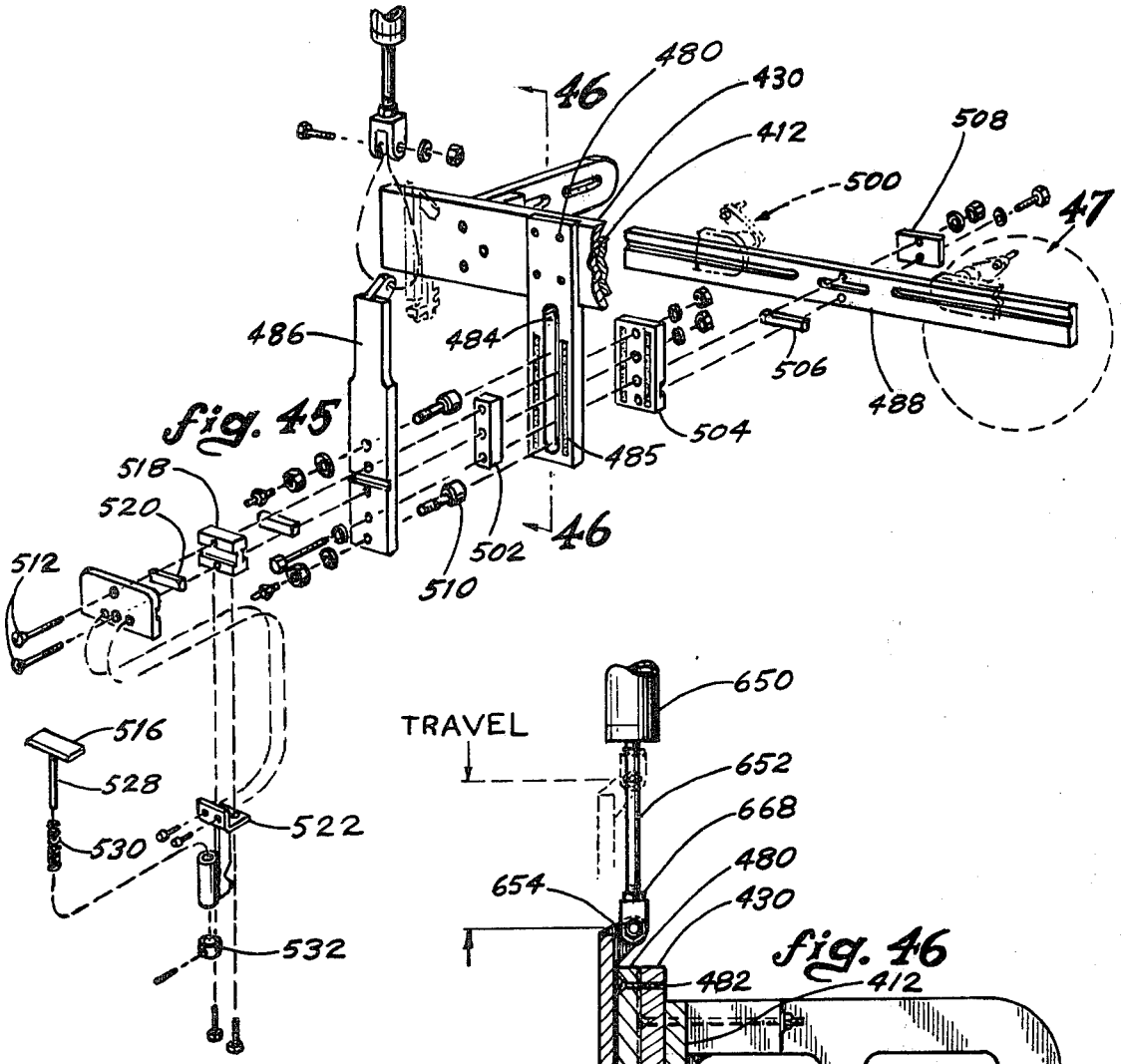

FIG. 45 is an exploded perspective view of a portion of the support means for the body blank fold mechanism, with portions cut away for clarity of illustration.

Figure 46:
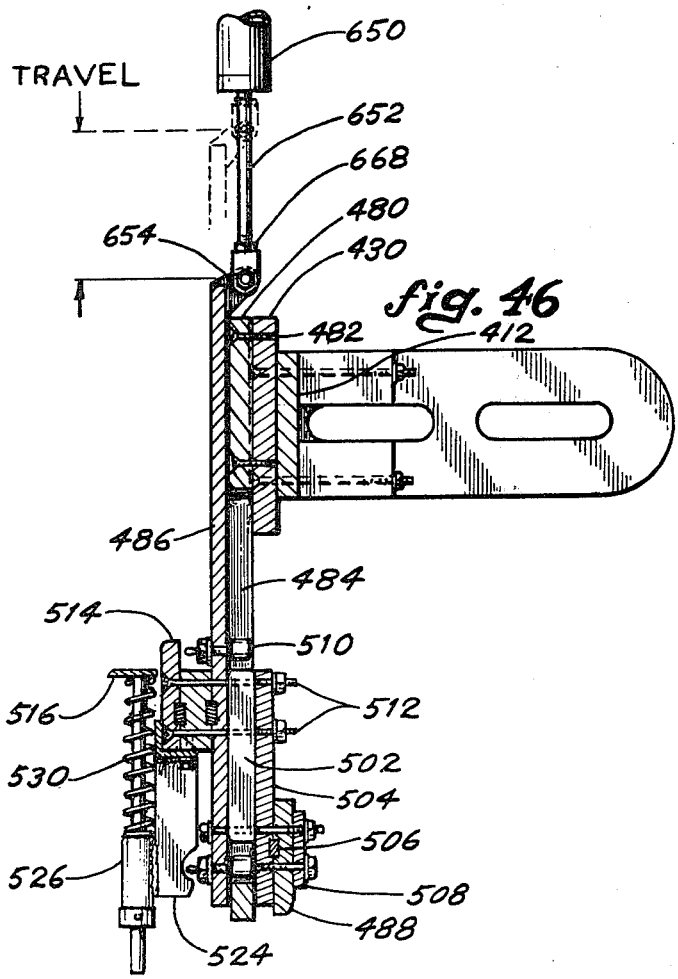

FIG. 46 is a vertical sectional view of the subassembly of FIG. 45 as indicated by the line 46—46 of FIG. 45.

Figure 47:
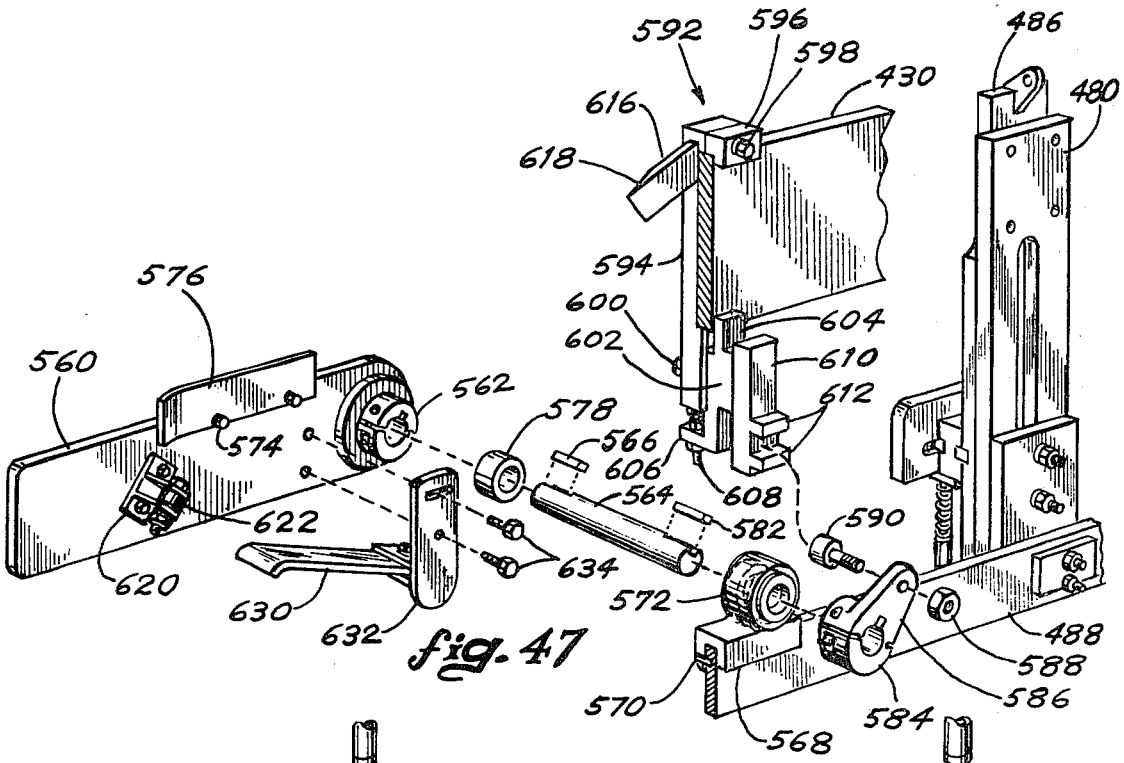

FIG. 47 is an exploded perspective view, with parts cut away, of components of the body blank folding mechanism.

Figure 48:
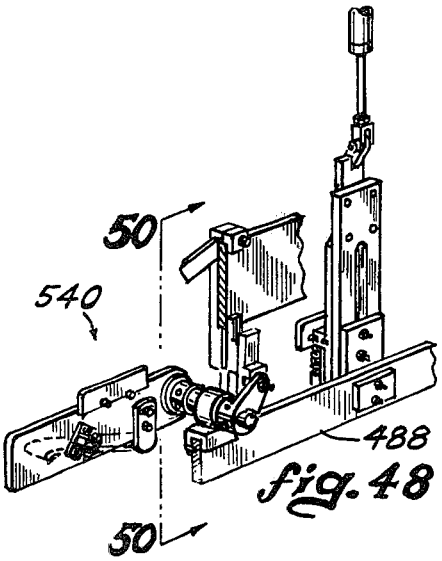

FIG. 48 is a partial perspective view of the components of FIG. 47 in assembled relationship, with portions cut away.

Figure 49:
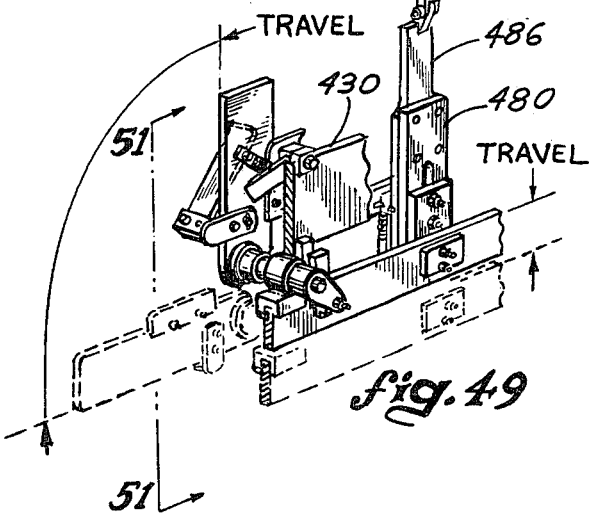

FIG. 49 is a perspective view, with portions cut away, of the body blank fold mechanism of FIG. 48 in the fully raised and articulated position and, in phantom outline, of the flat unarticulated position.

Figure 50:
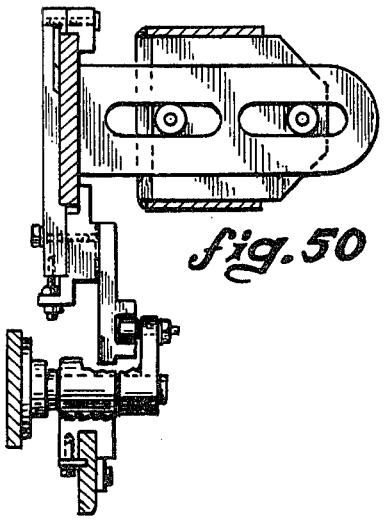

FIG. 50 is a vertical section on the line 50—50 of FIG. 48.

Figure 51:
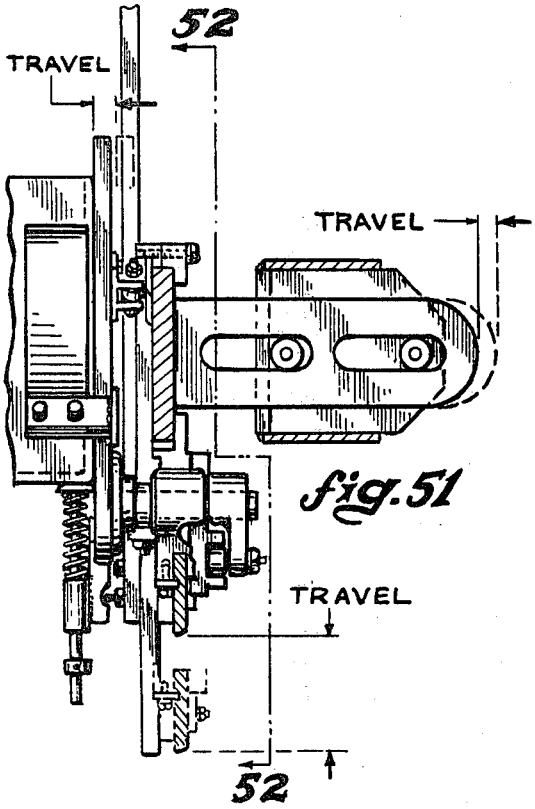

FIG. 51 is a section on the line 51—51 of FIG. 49.

Figure 52:
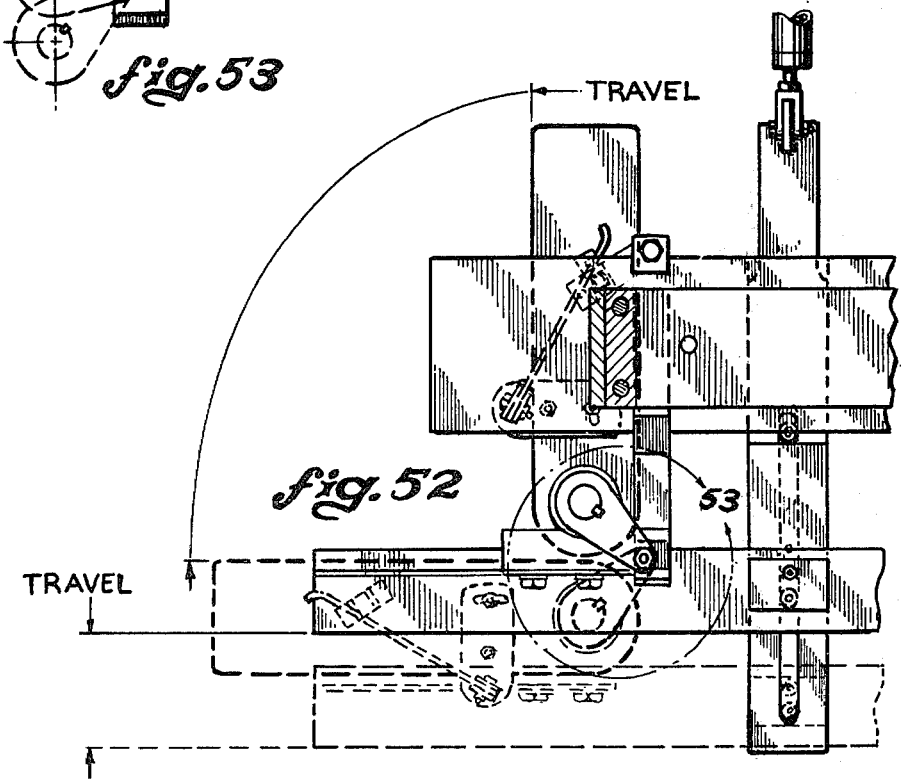

FIG. 52 is a vertical section on the line 52—52 of FIG. 51.

Figure 53:
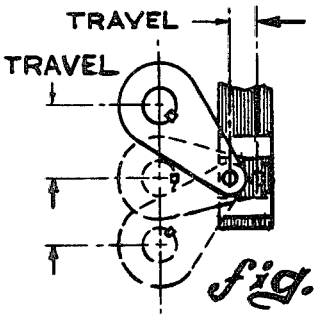

FIG. 53 is a schematic diagram of a portion of the cam mechanism for effecting folding of the body blank fold mechanism.

Figure 54:
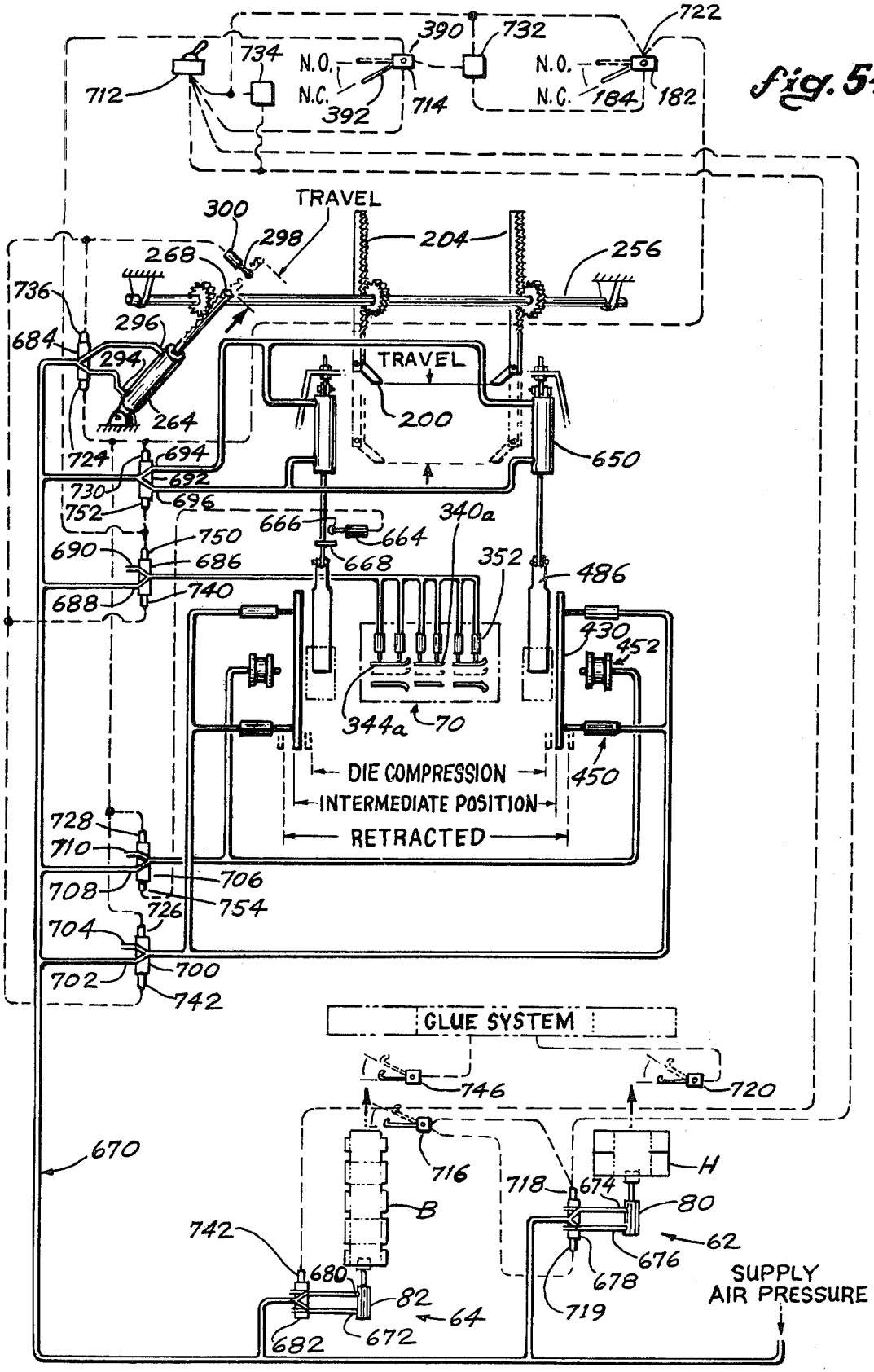

FIG. 54 is a schematic diagram of an electromechanical control system for the machine.

FIG. 55 is a schematic diagram of the electrical control system of the machine.

DESCRIPTION OF THE PREFERRED EMBODIMENT

The presently preferred embodiment of machine for making the H-divider containers has the general arrangement shown in FIG. 1. A vertically elongate rigid framework 60 on one side mounts both a high hopper and feed assembly 62 and a low hopper and feed assembly 64. The upper assembly 62 holds and individually feeds a supply of horizontally disposed vertically stacked flat preformed H-divider blanks H while the lower assembly 64 holds and feeds, one at a time, a supply of horizontally disposed vertically stacked flat preformed body blanks B. A discharge conveyor assembly 66 is incorporated into the lower end of the machine framework 60.

The machine automatically performs the forming operations illustrated in FIG. 2. To this end, the machine at its upper end, at the level of the upper hopper assembly 62, incorporates an H-fold mechanism 68 in vertical alignment above a split mandrel means 70. The split mandrel 70, in turn, is flanked by opposite sides of a means 72 for folding and forming the body blank B about the mandrel means 70. A completed H-divider container C is formed in a single cycle of operation of the machine.

More particularly, the H-divider blank H and body blank B, which are typically of corrugated cardboard or fiberboard, may have the plan configurations shown in FIG. 2. The completed container C consists of a pair of these two blanks.

The preformed flat panel H is scored and cut to define relatively foldable areas including a pair of panel areas $H_v$ each of which, in turn, is transversely flanked by a pair of end wall panel areas $H_e$. Adjacent edges of each pair of panels $H_e$ are severed from one another by a slit or cut score 74 at opposite ends of a central transverse hinge line 76 having a predetermined score arrangement whose function and geometry will be explained presently. As will become apparent from an examination of FIG. 2, the panels $H_v$ of the flat blank H subsequently become the central vertical laminated divider panel of the completed container C while the areas $H_e$, when erected, define a pair of opposite walls of the completed container. During initial infeed travel of the blank H, a predetermined pattern of glue strips $G_h$-1 and $G_h$-2 is deposited on one of the panel areas $H_v$.

Preferably, as in FIG. 2*a*, the junction of the panel areas $H_e$ and $H_v$ takes the form of a press score $P_s$-1 on the bottom surface of the H-divider blank which will leave both skins intact. The separation 74 of an adjacent pair of panels $H_e$ may take the form of a gap or notch but preferably comprise a cut score or slit through both liners and the fluted intermediate layer.

The transverse hinge 76 comprises a slit score $S_s$-1 through the bottom liner and the fluted intermediate layer but not through the top liner. This slit score $S_s$-1 is aligned with cut scores 74. Between the inward ends of the cut scores 74 and the opposite ends of slit score $S_s$-1 there is a press score section $P_s$-2 5.4 centimeters ($2\frac{1}{8}$ in.) long on each side where the corrugated material is not slit in order to provide a solid contact area for downfeed fingers of the H-fold mechanism 68 during the folding operations which will be explained presently. The bottom liner only is press scored in sections $P_s$-2 of hinge 76 in order to pre-stretch the material to enable it to accomodate the 90° bend of the material on forming, with less resistance and with less deformation of the material. In some cases the cut scores 74 may be extended inwardly slightly, e.g., 1.6 centimeters ($\frac{5}{8}$ in.) beyond press score $P_s$-1.

In the process illustrated in FIG. 2, the four end panel areas $H_e$ are first rotated downwardly substantially 90° relative to the common plane of the two areas $H_v$. This initial folding occurs as a function of movement of the preformed flat blank H from the supply stack to an indexed position in the H-fold mechanism 68. The H-fold mechanism then engages opposite end press score portions $P_s$-2 of the hinge line 76 to move the blank downwardly, effecting folding of the panel areas $H_v$ against one another and simultaneously effecting rotation of the already folded end panel areas $H_e$. Thereafter, the H-divider areas $H_v$ are subjected to compression within the mandrel means 70, momentarily, preparatory to having a body blank B formed around the H-divider and mandrel.

The blank B is preformed with a pattern of notches and score lines to define a central bottom panel area $B_b$ that is longitudinally flanked by a pair of side wall areas $B_s$. The bottom panel area $B_b$ is transversely flanked at opposite sides by a pair of flaps $F_2$ while each of the areas $B_s$ is transversely flanked along opposite sides with marginal flaps $F_1$. If the completed container is of the type to undergo subsequent top sealing, the blank B may be provided at opposite ends with, e.g., cover flap portions $B_c$-1 and $B_c$-2, the latter having a longer longitudinal dimension than the cover flap $B_c$-1. The area $B_c$-2 is provided with opposite side marginal flaps $F_3$, offset from the extreme end of the area $B_c$-2. The area $B_c$-1 is provided along opposite sides with a pair of marginal flaps $F_4$ having ends coterminus with the adjacent or corresponding extreme edge of the blank B.

In the process illustrated in FIG. 2, the flat body blank B is delivered from the supply thereof into a flat indexed position beneath a fully formed H-divider held within the mandrel means 70 and slightly spaced therebeneath. Thereafter, the body blank fold and die plate mechanism 72 moves the blank B upwardly into contact with the lower edge of the H-divider, effects 90° folding of the areas $B_s$ relative to the bottom panel area $B_b$, and effects partial inward turning of all of the flaps $F_1$, $F_2$. Finally, the body blank fold and die plate mechanism completes inward folding and compression of the flaps $F_1$, $F_2$ to bring the glue stripes $G_b$ into adhering contact with the flue joint areas of the H-divider end wall areas $H_e$. Upon the next fully erected H-divider being introduced into the mandrel means 70, the fully formed container C is ejected from the mandrel means by the incoming H-divider.

As will presently appear the machine of FIG. 1 has a unique arrangement for integrating the H-fold mechanism 68 and the body blank fold and die plate mechanisms 72 into unitary sub-assemblies whereby the machine is readily adjustable to make containers of different sizes. Thus, referring to FIG. 3*a*, there is shown a container C-1 which is shallower than the container C of FIGS. 1 and 2 and having a different configuration of cover flaps. FIG. 3*b* shows a shallow container C-2 of relatively elongate configuration, with a different configuration of end panel areas of the H-divider and with short marginal top flaps in lieu of cover flaps. FIG. 3*c* shows a relatively deep container C-3. It will be understood that these different species of containers are merely exemplary of the broad range of sizes and configurations which can be made by a single machine of the invention.

More particularly, the framework 60 of the machine comprises a rigid assembly of corner posts and crossbeams, some of the latter of which are adapted to hold the hopper and feed means 62 and 64 in superposed spaced relationship on one side of the machine. These hopper and feed assemblies and the manner of their adjustable connection to the machine frame, per se, form no part of the present invention but may, for example, be like those disclosed in my application, Ser. No. 718,130 and are essentially identical to one another in construction. For present purposes, suffice it to say that each comprises a sub-frame 78 adjustably mounting a kicker cylinder mechanism 80, 82 for individually stripping the bottom one of the preformed blanks from the stack. Each of the kicker cylinders has a sufficiently large stroke, as indicated, to deliver the blank into the nip of spaced pairs of drive wheels 84.

Each hopper assembly also mounts a glue gun mechanism 86 positioned between the pairs of drive wheels for depositing predetermined patterns of glue stripes on each of the blanks H and B. While not illustrated, it will be understood that each of the glue guns has its individual control system for the purpose, as for example, that shown in my co-pending application Ser. No. 846,899. Each hopper assembly also mounts feed wheels 88, under an overhead drag shoe 94, 96, engagable with the underside of the corresponding blank, each blank being finally arrested in an indexed position within the machine between a corresponding stop means and vertical flange of a drag shoe. Thus, referring to FIG. 4, the machine framework mounts a vertically extending stop means 90 at the level of the nip of the array of drive wheels of the upper hopper assembly 62 to arrest the blank H, while in the lower portion of the framework there is provided a vertically extending stop means 92 for arresting a blank B in an indexed position in the machine.

As is shown in FIGS. 5 and 6, the machine framework 60 provides means for integrating the H-fold means 68 and the body blank fold and die plate means 72 into a common adjustable assembly. Referring to FIGS. 5 and 6, the framework 60 has a parallel pair of spaced rigid cross-beams 98 oriented perpendicularly to the infeed direction of the blanks H and B. Each of these, on its inner vertical face, rigidly mounts a horizontally extending bar 100 defining a track for slidably adjustably supporting one end of the pair of parallel spaced apart die frame assemblies 102. The assemblies 102 are oriented parallel to the infeed direction of the blanks H and B.

Referring to FIG. 6, each of the die frame assemblies 102 includes a beam 104 of C-shaped cross-section, both of whose ends are closed by a rigidly affixed hanger strap 106. Each of these hanger straps is secured at its upper end to a bracket member 108, and each of these brackets is provided on its outer face with horizontally extending spaced bars 110 adapted to slidably embrace upper and lower sides of the corresponding bar 100 of the frame member 98.

As will later appear, each die frame assembly 102 mounts one side of the body blank fold and die plate means 72. For present purposes, suffice it to say that each die plate assembly 102 also supports one side of the H-fold mechanism 68.

Referring to FIG. 5, the H-fold mechanism includes a parallel vertically extending pair of tubes 116 of rectangular cross-section comprising portions of opposite sides of the mechanism 68. The sub-assemblies, of which the tubes 116 form a part, are mirror images of one another and each is rigidly interconnected to one of the pair of die frame assemblies 102 in the manner best seen in FIG. 6. Thus, a spaced pair of bars 118 are rigidly secured, as by welding, to the upper horizontal flange of the C-shaped beam 104 so as to project horizontally inwardly thereof to be rigidly interconnected, as by welding, to a lower end portion of one of the tubes 116. For rigidifying the structure, a strap 120 of generally inverted L-shaped configuration has a lower end secured, as by welding, to outer ends of the pair of bars 118 and has its upper end inner end secured, as by welding, to the outside face of an intermediate portion of the tube 116.

As will now be apparent, the machine can be adjusted for various widths of blanks H and B by varying the spacing between the pair of die frame assemblies 102 in order to in turn vary the width between the opposite sides of the H-fold mechanism 68 and of body blank fold mechanism 72. A preferred means of accomplishing such adjustment is shown in FIG. 5.

Each of the hanger brackets 108 of the pair of die frame assemblies 102 is fitted at an upper end with an inwardly facing block 122. Each of the blocks 122 is formed with a horizontally disposed tapped bore to threadedly receive one end portion of one of a pair of elongate threaded adjustment rods 124. One end portion of each of the rods 124 is threaded in the opposite direction from the other end portion. In a similar manner, each of the vertical tubes 116 adjacent its upper end is fitted with a bracket 126 between whose arms there is mounted a block 128 also formed with a horizontally disposed tapped bore of either left hand or right hand threads and threadedly engaged by a left hand and right hand threaded adjustment rod 130.

The adjustment rod 130 is rotatably mounted at one end in a bearing 132 that is supported by a bracket 134 on the frame 60, the bearings supporting the rod for rotation while holding it against axial movement. A spur gear 136 is coaxially keyed to the external projecting end of the rod 130. The other two adjustment rods 124 are similarly mounted for rotation while being held against axial displacement. Thus, as is best indicated in FIG. 6, the machine frame has a pair of brackets 138 positioned to provide bearing support for projecting ends of the rods 124, each projecting end being fitted with another sprocket 136. At the mid-portion of the machine frame it is fitted with rigidly mounted inwardly extending short cantilever box beam structures 140 (FIG. 7), through which mid-portions of the pair of adjustment rods 124 extend, mid-portions of the rod being fitted with bearing means 142 adapted to suport the adjustment rods for rotation and hold them against axial movement. All three of the sprockets 136 are disposed in a common vertical plane and mount an endless chain 146, one or all of the sprockets being adapted to receive a crank for co-rotation of the sprockets and, therefore, synchronous adjustment of the width of the H-fold mechanism 68 and body blank fold mechanism 72.

The machine of FIG. 1 incorporates means for adjusting to various lengths of the blanks H and B, as in my aforesaid application Ser. No. 718,130. Briefly referring to FIGS. 8 and 9 with reference to the blank H, the material stop means 90 may be mounted on a sub-frame 150 which includes a parallel pair of horizontally extending gear racks 152. An adjustment shaft mounted in the sub-frame 78 of the hopper and feed means is then mounted to span the space between the pair of racks 152 and is fitted at opposite ends with spur gears so that by rotation of the crank fitted to the crossing adjustment shaft the stop means 90 may be adjusted inwardly and outwardly relative to the vertical flange of the drag shoe 94. A similar gear and rack adjustment is employed for the hopper and feed means sub-frames 78, drivingly engaged with the sub-frame 150 and gear racks 152.

As is shown in FIG. 2, the initial step in forming the H-divider from the blank H is to turn the end panel areas $H_e$ downwardly 90° relative to the common plane of the areas $H_v$. This step is performed as a function of movement of the blank from the supply hopper 62 to an indexed position in the machine against the stop means 90. The specific means employed for this purpose in the preferred embodiment of the machine are shown in FIGS. 8 through 12.

An inner portion of the sub-frame 78 of the hopper system mounts a pair of support shoes 160, mounted in parallel. The support shoes 160 take the form of plates of the configuration best seen in FIG. 9. The plates are mounted parallel to one another, parallel to the infeed direction of the blanks H, and by a means permitting adjustment of the spacing therebetween which, as is apparent, should conform to the corresponding dimension of the areas $H_v$. As is shown in FIG. 9, the upper horizontal edges of the support shoes 160 are parallel to and slightly spaced below the nip between the infeed wheels 84, 88.

Each of the vertically extending tubes 116 adjustably mounts an H-blank edge guide and fold shoe 164 of the configuration best seen in FIG. 10. Each of the fold shoes 164 is a generally triangularly shaped plate with one vertical edge connected to one inner vertical edge of the corresponding tube 116 by a flush hinge means such as the illustrated piano hinge connection 168. Preferably, the inner face of shoe 164 is very slightly inwardly disposed from the inner face of tube 116. The lower edge of the folding shoe 164 tapers upwardly and rearwardly and is contoured to effect downward folding of the areas $H_e$ of a blank H as a function of its infeed travel. More specifically, the lower edge 166 of the fold shoe, from its junction with the hinge means 168, is gradually twisted or warped through 90° so that its upstream end is engagable with the top surface of the blank H.

In order to hold the fold shoes 164 in adjusted positions, each vertical tube 116, on its outside surface, is fitted with an arm 170 to mount a fastener means 172 engagable with a slot at one end of an adjustment arm 174 whose other end is pivotally connected, as at 176, to another arm 178 pivotally connected to the outside of the corresponding fold shoe 164. By this means, the convergent fold shoes can be fixed in a desired adjusted position, as indicated by the two phantom outlined positions thereof in FIG. 10.

Referring to FIG. 8, it will be seen that the pair of fold shoes 164 are convergently arranged with respect to the infeed direction of blanks H. Thus, as is shown in FIG. 11, the panel areas $H_e$ are cammed downwardly successively by the lower edges 166 of the fold shoes. At the same time, the incoming panel is centered with respect to the space between the confronting inner surfaces of the pair of vertical tubes 116. The stop means 90 physically arrests the blank H in an indexed position when the leading edge of the blank contacts the stop means and the trailing edge of the blank is just within the vertical flange of the drag shoe 94. The spacing or adjustment of the stop means is such that the blank H is halted with its projected central transverse fold line 76 intersecting the vertical center lines of the inside surfaces of the pair of tubes 116 as shown in FIG. 12. From the foregoing, it will now be seen that members 164 function both as shoes for folding the areas $H_e$ of the blank downwardly and, also, as material edge guides.

When the blank H is in the partially folded and indexed position of FIG. 12, the stop means 90 initiates the next step in the formation of the H-divider, i.e., 90° folding of the areas $H_v$ on one another about a bottom hinge 76, as in FIG. 2. For this purpose, the stop means 90 includes a switch 182 that is actuable by a switch arm 184 that is normally biased inwardly of the stop means, as in FIG. 9, so as to be depressed and therefore close normally open contacts of the switch by an incoming leading edge of a blank H. As a result, the H-fold means 68 is energized to effect the sequence of folding steps illustrated in FIGS. 18 and 19, by the means shown in FIGS. 13 through 22.

Referring to FIGS. 18 and 19, each of the pair of cantilever beams 140 is of box beam configuration and the aligned beams have their inner ends spaced apart from one another to define a gap therebetween into which the two folded panel areas $H_v$ can freely pass. Each of the cantilever beams 140 supports one half of the split mandrel means 70. Each of the beams 140 also supports, on its upper face, one half of the means for effecting 90° folding of the two areas $H_v$ of the blank H upon one another.

More specifically, that beam 140 which is closest to the supply hopper means 62 has a support and folding shoe 190 of the configuration illustrated in FIG. 18, while the other beam 140 rigidly mounts a support and folding shoe 192. Both shoes are of inverted generally L-shaped configuration defining oppositely extending horizontally disposed support legs, as illustrated in FIG. 19, to support the areas $H_v$ of the blank H in flat indexed position. The spacing between the confronting vertical legs or flanges of the shoes 190, 192 define a vertically extending clearance gap to freely admit the double thickness of material when the two panel areas $H_v$ are folded upon one another and this gap is centered along the vertical longitudinal center lines of the pair of tubes 116. Each of the shoes 190, 192 is formed with a radius at the juncture of the vertical and horizontal legs thereof. Thus, when a downwardly acting force is applied to the coplanar panel areas $H_v$ along the spaced press scores $P_s$-1 of the fold line 76, the blank is forced downwardly and the panel areas $H_v$ are cammed together.

The power means for effecting folding of the panel areas $H_v$ is best shown in FIGS. 13 through 14. Briefly, each of the tubes 116 serves as a guide for the vertical coreciprocation of one of a pair of fold fingers 200, the fingers being engagable with the top side of the blank H at the press scores $P_2$-2 along the transverse center line 76 in order to effect folding of the panel areas $H_v$.

More specifically, each of the tubes 116 is preferably of rectangular cross-sectional configuration and each is formed along the vertical center line of its inside wall with a vertically extending slot 202 of a vertical length corresponding to the stroke range of the fingers 200. Within each tube 116 a vertically elongate rod 204 is mounted for vertical reciprocation and each of the rods 204 at its lower end mounts one of the pair of fingers 200.

Preferably, each finger 200 takes the form of a thin, e.g., 0.158 centimeters (1/16 in.), sheet of spring steel of the configuration best seen in FIG. 15. Each finger is pivotally connected, as by means 206, within a slot 208 formed in the lower end of the rod 204 and opening to the inside and lower end of the rod. A spring 210 is interconnected between the pivot end of the finger 200 and a higher peg 212 fitted within the slot 208 in order to normally bias the corresponding finger 200 into the outwardly projecting drive position indicated in solid outline through the slot 202 of the corresponding guide tube 116. A stop means 214 is provided for this purpose, preferably taking the form of a shoulder integrally defined within the slot 208, adapted to contact the adjacent edge of finger 200 at a point above the pivot means 206. The same edge of the finger 200 is formed with a radius as indicated at 216, providing clearance for turning of the finger 200 to the phantom outline position shown in which the finger is in alignment with the rod 204 to clear the blank H during upward retraction.

At its pivot end the finger 200 has a pair of shims 218, or the like, secured thereto on opposite sides to provide a thickness defining a smoothly sliding rotary bearing surface on confronting surfaces of the slot 208 and to precisely locate the finger 200 along the vertical longitudinal center line of the tube slot 202. When the finger 200 is in the normal outwardly projecting position, a lower end 220 thereof is horizontally disposed for contact with the top side of a blank H along the transverse fold line 76 on one of the press scores $P_s$-2.

Each rod 204 is smoothly guided for vertical reciprocation within the corresponding tube 116 by bearing means such as are shown in FIGS. 13 and 14. Thus, in order to guide the lower end of the rod 204, while maintaining proper alignment of the corresponding finger 200, the lower end of the rod is fitted with a pair of brackets 224 projecting from opposite sides of the rod in a direction normal to the direction of the projecting finger 200. Each of the brackets 224 at its outer end mounts a roller bearing 226 for rolling contact with the corresponding confronting inside wall surface of the tube 116. Just above the bearings 226 the same opposite sides of the rod 204 are fitted with a pair of roller bearings 228 on axes vertically offset from one another adapted for smooth rolling engagement with the other pair of inside wall surfaces of the tube 116.

The upper end of each rod 204 is guided for smooth vertical reciprocation by means of roller bearings 230 mounted on the tube 116 rather than on the rod itself. A pair of the bearings 230 are employed, each being mounted on an external bracket 232 flanking an opening 234 in the corresponding tube wall through which the bearings 230 extend for smooth rolling contact with a pair of opposite smooth sides of the rod 204. As is shown in FIGS. 13 and 14, the pair of bearings 230 for each of the rods 204 is situated just above the upper end of the corresponding slot 202.

In order to effect simultaneous synchronous vertical reciprocation of the rods 204, a powered rack and pinion means is preferably employed. To this end, each of the rods 204 is formed on one side with a vertically elongate rack portion 240 drivingly engaged by a spur gear 242. Each of these spur gears is mounted externally of the corresponding tube 116 adjacent the upper end of the slot 202 in a bracket 244 and projects through a vertically elongate window 246 formed in the corresponding side wall of the tube for driving engagement with the rack portion 240. As is best seen in FIG. 14, in order to insure and maintain driving engagement of the toothed elements, each tube 116 internally mounts a bearing 248 on a support shaft 250 for contact with a smooth side of the rod 204 opposite to the rack portion 240. As shown, the bearing 248 has its rotary axis parallel to and horizontally aligned with the rotary axis of the corresponding spur gear 242.

As is shown in FIG. 13, the pair of spur gears 242 are coaxially aligned and have their hubs drivingly engaged by an elongate rotary power shaft 256. Each of the ends of the power shaft 256 is mounted in a bearing bracket 258 connected to a portion of the machine frame 60.

Rotary oscillation of the power shaft 256 to effect vertical reciprocation of the rods 204 and fingers 200 is preferably effected by a pneumatically powered rack and pinion means.

Referring to FIG. 13, a double acting pneumatic power cylinder 264 has one end pivotally connected, by means 266, to a portion of the machine frame 60 at a location offset laterally and downwardly from the shaft 256 and oriented 90° relative to the shaft. While not shown, it will of course be understood that the power cylinder 264 houses a reciprocable piston for axially reciprocating a piston rod that is externally fitted with an elongate gear rack 268 projecting towards the power shaft 256. For drivingly interconnecting the gear rack 268 and shaft 256 a floating bracket means 270 is employed, of the structure shown in FIGS. 16 and 17.

The bracket means 270 has a housing 272 formed with a spaced pair of somewhat triangularly shaped side walls 274. These side walls are formed with coaxially aligned apertures through which the shaft 256 passes and each of the apertures is fitted with a snap ring 276 for retaining a ball bearing assembly 278 interposed between the shaft 256 and the housing 272. Within the housing a spur gear 280 is keyed to the shaft 256 and located against axial displacement on the shaft by means of a collar 282 fitted with a set screw 284. The spur gear 280 is in driven engagement with the gear teeth formed on the upper side of the rack 268, which passes through the bracket 270 through roller bearing guides.

More particularly, a floor member 286 of the housing 272 mounts a spaced pair of roller bearings 288 having rolling contact with the opposite vertical sides of the rack 268. As is shown in FIG. 16, each of the side walls 274 of the housing 272 is formed with a spaced pair of downwardly projecting lobes 290, straddling opposite sides of the housing floor 286, so that the two pairs of lobes provide means for mounting roller bearings 292 in running contact with the underside of the rack 268 to maintain driving meshing contact of the teeth of the rack 268 and spur gear 280.

Referring to FIG. 13, it will be noted that the pneumatic cylinder 264 is provided with ports 294 and 296 at opposite ends thereof. Accordingly, when the pressure side of the pneumatic circuit is in communication with the port 294, the other port being vented, the rack 268 is forced outwardly, effecting corresponding rotation of the shaft 256 to drive the fingers 200 downwardly via the rods 204. When the fingers 200 reach the lower limit of their stroke, the outermost end of the rack 268 comes into contact with the actuating arm 298 of a limit switch 300 which, among other things, effects a reversal of the valve control for the pneumatic cylinder 264. Thereupon, the port 294 is vented to atmosphere while the source of compressed air is in communication with the other port 296, thus effecting a retraction of the gear rack 268, rods 204, and fingers 200.

The stroke range of the fingers 200, relative to the blank H and the mandrel means 70, is shown in FIG. 19. Thus, the fingers 200 are represented in solid outline at the upper end of their stroke range, corresponding to the upper end of the slot 202, at an elevation spaced above the indexed partially folded blank H. In the indexed position, the end wall panels $H_e$ of the blank H have been folded downwardly through 90°. As the fingers 200 descend, they engage opposite sides of the blank H to effect the folding upon one another of the panel areas $H_v$ along the hinge 76 as a function of the cam curvature of the fold shoes 190, 192. This condition is represented in the first phantom outline position 200' of FIG. 19.

Upon continued downward movement of the fingers 200 to the position indicated at 200'', the areas $H_v$ are fully folded relative to one another. The stroke range of the fingers 200 is such that at the position 200'' the lower edge of the blank H, i.e., lower edges of the areas $H_e$ and the folded areas $H_v$ project slightly below the bottom face of the mandrel means 70. At the same time, the opposing faces of the split mandrel 70 define a gap like the gap between the vertical legs of the fold members 190, 192 such that there is a clearance between the confronting surfaces of the areas $H_v$, one of which has the glue stripes $G_h$-1 and $G_h$-2 thereon. At this point, in response to actuation of the switch 300, the opposite halves of the split mandrel means 70 close upon one another to effect compression and adhesive connection of the two areas $H_v$ upon one another.

Each of the mandrel supporting cantilever box beam structures 140 includes a horizontally extending parallel pair of bars 304 defining its vertical sides. At inner ends, the pair of bars 304 are formed with a confronting pair of vertically extending slots 306 adapted to receive upper ends of a vertically extending parallel pair of mandrel frame plates 310 which are rigidly clamped in place by a pair of machine fasteners 308 interconnecting the pair of bars 304. The mandrel means 70 consists of cooperating mandrel assemblies 70*a* and 70*b*, each of which is mounted to the corresponding beam structure 140 by the means just described.

Both mandrel assemblies 70*a* and 70*b* have the same basic adjustable framework. Accordingly, just one will be described in detail.

More particularly, the mandrel frame plates 310 are rigid bars formed on their confronting inner surfaces with a pair of horizontally extending opposed way slots 314. Each pair of confronting slots 314 slidably mounts a horizontally extending pair of mutually slidably engaged adjustment bars 316. A vertically spaced apart series of horizontally extending machine screw fasteners 318 serve to hold the mandrel frame members 310 in assembled relationship with slidable clearance for the horizontally extending adjustment bars 314. Each of the bars 314 at one end is rigidly fastened to one end of a horizontally spaced apart vertically extending pair of mandrel corner members 320. The outer end of each slidable bar 314 is formed with a tapped bore for mounting one end of a mandrel vertical side plate member 322 by means of flush head fasteners 324.

A left and right hand screw mechanism is mounted between the mandrel frame plates 310 as a means of adjusting the width of the corresponding mandrel frame section 70*a* or 70*b*, i.e., the width between the side frame plates 322. More particularly, in the gap between the pair of frame plates 310, in the central area, a pair of vertically extending horizontally spaced apart support blocks 326 are mounted. These blocks are formed with horizontally extending left or right hand threaded coaxially aligned bores to threadedly receive either a left hand threaded or right hand threaded adjustment shaft 328 and 330. Both of these adjustment shafts are formed with a longitudinally extending keyway and between the pair of blocks 326 each shaft coaxially supports a spur gear 332 each of which is keyed to its shaft and in driving meshing engagement with the other spur gear.

An outer end of each of the adjustment shafts 328, 330 is rotatably mounted in a manner to hold the shaft against axial movement in a block 334 that, in turn, is mounted to the mid-portion on the backside of one of the corner frame members 320. The outer end of each adjustment shaft 328, 330 is fitted with a flush socket head 336 providing a means for co-rotation of the two adjustment shafts by their spur gears and corresponding lateral adjustment of the corner frame members 320 and side frame members 322.

One of the assemblies of the split mandrel means 70 is provided with fixed shoes while the other assembly is provided with movable shoes. The arrangement is such that when the movable shoes are in a retracted position an ample clearance space is provided between the two sets of shoes in order to receive the two panel areas $H_v$ folded therebetween. Then, when the switch 300 is actuated, inward movement of the movable shoes is effected whereby to compress the folded panels $H_v$ against one another to be glued together by the glue stripes $G_h$-1 and $G_h$-2. Then, the movable shoes are immediately retracted, leaving the folded H-divider relatively loose in the split mandrel in the clearance gap between the shoes preparatory to the folding thereabout of the blank B.

More specifically, the mandrel sub-assembly 70*b*, for example, is fitted with a vertically extending shoe 340 in its center fixed to the outer face of the outer mandrel frame member 310 by a vertically spaced apart plurality of flush head fasteners 342. In similar fashion, each of the corner frame members 320 has a vertically extending shoe 344 secured thereto, secured in place by flush head fasteners 346. The lower horizontal edges of the three shoes 342, 344, are all in a common horizontal plane with the lower edges of the side plates 322. The side shoes 344 extend upwardly above the upper edge of the central shoe 340 and are curved as indicated to provide guides and auxiliary cams for the folding of the panel areas $H_v$. Each of the long shoes 344 is also fitted at its upper end with a sidewardly facing curved cam surface 348 with a lower edge in the same plane as the vertical plane of the sidewardly facing side plates 322. The outer vertical surfaces of the three shoes 344, 340 are in the same plane as the vertical leg of the overlying support shoe 190.

The other mandrel assembly 70*a* is also fitted with a set of the shoes 340*a*, 344*a* arranged in the same way but mounted for movement inwardly and outwardly towards and away from the confronting shoes 340, 344 of the assembly 70*b*. More specifically, the assembly 70*a* is fitted with a central shoe 340*a* and corner shoes 344*a*, with each of the shoes being drivingly connected to a pneumatic power cylinder for extension and each being spring biased to a normally retracted position.

Referring to the left side of FIG. 23, each of the vertical frame members 310, 320 interiorly of the assembly is fitted with a vertically spaced apart pair of pneumatic cylinders 352, in registration with a bore through its supporting member. For example, referring to FIG. 24, the inner central vertical frame plate 310 is formed with vertically spaced apart bores 354 seating a body portion of the corresponding pneumatic cylinder so that a piston rod 356 thereof, when actuated, forces the corresponding central vertical shoe 342*a* outwardly therefrom to compress the two panel areas $H_v$ against one another against the other vertical shoe 340. It will of course be understood that when the piston rods 356 are in the retracted condition they lie flush with the face of the vertical mandrel frame member 310. In order to normally bias each of the shoes 340*a*, 344*a* to retracted position, each is fitted with a countersunk rod 360 extending through a counterbore 362 formed in the corresponding support member, e.g., the plate 310. At its back end each rod 360 is sleeved and fitted with a washer 364 under a nut on the rod forming a seat for a spring 368 coaxially arranged around the rod and having its other end seated on the floor of the counterbore 362.

Referring now to FIG. 22, it will be noted that the clearance space between the inside surface of a vertically extending guide tube 116 and the vertical plane of the outside surface of the corresponding mandrel side plate 322 is greater than the thickness of the box material, i.e., the indicated width of the end panel $H_e$. With this arrangement, ample clearance is provided for rotation of the panel areas $H_e$ as the panel areas $H_v$ are folded upon one another as the blank H is fed downwardly by the fingers 200, in the manner indicated in FIG. 18. In order to insure that the panels $H_e$ are firmly pressed flat against the corresponding mandrel side plates 322 when the blank H has been fully lowered, and to hold the formed H-divider in place as blank B is formed, a hold-in means 370, such as is shown in FIG. 21, is provided.

More particularly, the backside of each vertical guide tube 116, at about the height of the upper end of the mandrel means 70, rigidly mounts a horizontally extending axle rod 374, opposite ends of which protrude beyond the sides of the guide tube, to pivotally mount a pair of bell cranks 376. These cranks are mounted just above the bracket arms 118, each of which rigidly mounts a lock nut fitted adjustment screw 378 having an inner end in contact with one arm of the corresponding bell crank 376. The other end of each bell crank is fitted with a downwardly and inwardly projecting spring steel rod 380 which biases one of the end flaps $H_e$ into firm but slidable contact with the confronting surface of the mandrel side plate 322.

As has been mentioned, when the blank H is fully folded and fully inserted into the mandrel 70, its then lower edges project slightly beyond the horizontal plane of the lower end of the split mandrel. This condition is represented, for example, in FIG. 24 which also shows the panel areas $H_v$ being compressed upon one another. At this moment, just before release of air pressure in the pneumatic cylinders 352 and retraction of the movable shoes, the feed fingers 200 are in the lower phantom outline position 200'' indicated in FIG. 25 and the box material top liner is compressed therearound so that the finger 200 has made its imprint in the surface liner of the material. These imprints, in effect, define open ended pockets through which the fingers 200 escape sidewardly outwardly while turning to assume the straight downwardly printing dotted outline position of FIG. 15 as the finger 200 rises and so rotates out of its pocket. With this arrangement, there is no danger of fingers 200 remaining outwardly extending and wiping across the glue stripes $G_h$-2 with which the fingers would otherwise be in line upon their retraction. It is to be noted that in this phase of operation, i.e., as the fingers withdraw, the cylinders 352 have been vented and the movable shoes 340*a* and 344*a* are in their retracted positions.

Referring to FIG. 27, a fully formed and glued H-divider is retained, by springs 380, in the split mandrel means 70 in spaced relation to a body blank B that is held in an indexed position against the stop means 92 and on the body blank fold and die plate means 72. FIGS. 27 through 38 illustrate the sequence of steps in folding the blank B around the H-divider. FIGS. 39 through 53 illustrate, in detail, the structure of the means 72 by which the folding operation is accomplished.

Referring to FIG. 28, the stop means 92 includes a switch 390 having a switch arm 392 which is actuatable by the leading edge of the flat blank B. While the mandrel is not shown in the Figure, it will be understood that an upwardly extending fixed vertical flange of the stop means 92 arrests the blank B in an indexed position such that the bottom panel $B_b$ is centered with respect to the mandrel means 70 thereabove which then holds a fully formed and glued H-divider. In response to actuation of the switch 390, the body blank fold and die plate means 72 then performs the following sequence of folding operations on the blank B.

As the blank B is lifted by the means 72, its bottom panel $B_b$, while still flat, engages the downwardly protruding edges of the H-divider which is thereafter carried upwardly until the panel $B_b$ engages the bottom of the mandrel means 70. Thereupon, the side panels $B_s$ and flaps $F_2$ commence turning upwardly relative to the bottom panel $B_b$. This phase of movement is best illustrated in FIG. 29. Thereafter, the means 72 effects further folding of the panels $B_s$ through 90°, exerting a self-centering action on the H-divider, until the inside surfaces of the panels $B_s$ engage vertical edges of the H-divider end panels $H_e$. This is best shown in FIG. 34. Towards the end of this phase of movement, the marginal flaps $F_1$ of the body blank are partially turned inwardly relative to the H-divider end panels $H_e$. Thereafter, die plate portions of the means 72 are moved inwardly to complete 90° folding of the marginal flaps $F_1$ and $F_2$ and to press the glue stripes $G_b$ thereof into firm adhesive contact with the H-divider end panels $H_e$.

During a cycle of box formation, the opposite sides of the means 72 occupy three different laterally spaced positions relative to the blank B. Thus, during infeed movement of the blank B, the opposite sides of the means 72 occupy an intermediate position in which means 72 serve as a material support and edge guide for the blank. In order to fully fold the marginal flaps $F_1$ and $F_2$ into abrasive contact with the H-divider end walls, the opposite sides of the means 72 are moved inwardly into a die compression position. After the H-divider container has been fully formed, opposite sides of the means 72 are moved outwardly relative to one another to a retracted position, beyond the intermediate position, in order to provide clearance therebetween for marginal flaps $F_4$ as the completed container is driven therethrough by the H-divider next entering the split mandrel.

More particularly, FIG. 28 shows the components defining one side of the body blank die and fold means 72. These components are supported on one of the die frame assemblies 102 whose C-shaped cross-beam 104 mounts an inwardly and outwardly reciprocable yoke assembly 400. The yoke assembly, it its inner end, has a die support plate assembly 402 that, in turn, is mounted for a limited range of reciprocation inwardly and outwardly relative to the yoke assembly 400. The inside of the die support plate assembly 402, at its center, mounts a vertically reciprocable slide plate assembly 404 whose lower end carries a horizontal lift beam assembly 406. This last assembly includes body blank edge guide elements as well as articulated elements to effect lifting, folding, and compression of the blank B.

All of these sub-assemblies 400 through 406 are mounted in the machine frame 60 on both sides by means of the pair of adjustable die frame assemblies 102 whose detailed construction is best seen in FIGS. 40–44

The yoke assembly 400 includes a generally C-shaped in plan yoke 410 defined by a central section 412 and a pair of horizontally rearwardly projecting legs 414. A vertically disposed web portion 416 of the die frame member 104 is formed with a laterally spaced apart pair of apertures 418 through which the yoke legs 414 extend into the C-shaped frame member and rearwardly relative to the web section 416, alongside vertically disposed gussetts 420 internally reinforcing the C-shaped member 104.

Each gussett 420 is fitted with a horizontally aligned and spaced apart pair of fastener means 422 to support a pair of roller bearings 424 having rolling engagement within corresponding ones of a pair of horizontally aligned closed end slots 426 formed in the corresponding arm 414 of the yoke 410. By this means, each yoke 410 is mounted for movement of its central section 412 inwardly and outwardly relative to the inner face of the web section 416 of the C-beam 104, the range of reciprocation being limited to the horizontal length of the slots 426.

The mounting means 402 includes a mounting plate 430 of horizontally elongate rectangular configuration and secured against the inner face of the yoke center section 412 to be reciprocable therewith. More specifically, the internal corners of the yoke 410 are fitted with a pair of corner blocks 432 and a pair of flush head fasteners 434 extend through aligned bores in mounting plate 430, yoke center section 412, corner blocks 432, and a stop member 436 to rigidly hold the components together. Each stop member 436 is in interfering confronting alignment with a portion of the vertical back face of the web 416 of the beam 104, having an elastomeric bump pad 438 to cushion stop engagement between the two. Thus, as is shown in FIG. 44, engagement of the stop members 436 with the cushioned inner face of the web 416 defines the maximum extension of the yoke assembly 400, in the die compression position.

The yoke 410 and mounting plate 430 are biased into the retracted position by the spring means shown in FIG. 40. For this purpose, a parallel pair of laterally spaced apart parallel elongate fastener means 440 extend through aligned bores formed in the mounting plate 430, yoke center section 412, web 416 of the C-beam 104. Each of the flush head fastener means 440 coaxially mounts an elongate guide tube 442 having an outer end portion axially slidably mounted in the corresponding one of the openings through the web 416 and having its other end seated against a coaxial washer 444 which also serves as a seat for one end of a coaxially mounted spring 446. The other end of the spring 446 is seated on another washer 444 that is seated on the inner face of the web 416. An elastomeric bumper pad 448 is mounted on the front face of the C-beam web 416 to cushion retraction of the yoke assembly under the influence of the springs 446.

The yoke assembly 400 is moved from the retracted position of FIG. 40 to the intermediate position of FIG. 43 by means of a laterally spaced apart pair of outboard pneumatic cylinders 450, and from the intermediate position to the die compression position of FIG. 44 by means of a central die compression pneumatic cylinder 452. It will be noted that the mounting plate 430 extends horizontally laterally in opposite directions beyond the opposite ends of the yoke center section 412 and the outboard cylinders 450 are in operative alignment with these extensions of the mounting plate. The die compression cylinder 452 is centered with respect to the yoke center section 412 and is in operative alignment therewith.

More particularly, referring to FIG. 42, the web 416 of the C-beam 104, on its back side, rigidly mounts a pair of short tubes 454, each of which serves as a support for one of the outboard cylinders 450. A bracket means 456 is rigidly mounted within the horizontal flanges of the C-beam 104, as part of a means for effecting axial adjustment of the corresponding outboard cylinder 450. The housing of the cylinder 450 is axially slidably mounted in its support tube 454 and has a coaxial outwardly projecting adjustment screw 458 secured thereto which has threaded engagement with a central span of the bracket 456, the adjustment screw 458 being fitted with a lock nut 460.

As is shown in FIG. 40, each outboard cylinder 450 internally contains a piston 462 drivingly interconnected to a piston rod 464 that projects forwardly through aligned apertures in the cylinder housing end wall and the web 416 of the C-beam 104 for unidirectional driving engagement with the backside of one end of the mounting plate 430. As will now be apparent, when compressed air is admitted to an outboard cylinder 450, the piston 462 is urged outwardly until it bottoms out against the cylinder end wall, as in FIG. 43 and the adjustment screw 458 provides a means for precisely calibrating the position of the outboard cylinder 450 relative to its support tube 452 and, therefore, the intermediate position of the die mounting plate 430. In this connection, it should be noted that the articulating mechanisms of the means 406 also serve as a body blank support and edge guides whose positions can be precisely located because of the adjustment feature of the outboard cylinders 450.

The die compression cylinder 452 is also pneumatically powered. As is shown in FIG. 40, the die compression cylinder 452 has its housing rigidly secured to the backside of the web 416 of the C-beam 104 and, as is conventional, contains a piston 470 drivingly engaged with a coaxial piston rod 472 that is reciprocable through coaxially aligned apertures formed in the web 416 and the adjacent cylinder end wall. The cylinder 452 is so located that the operative end of the piston rod 472 is unidirectionally engageable with the center of the central section 412 of the yoke 410, and it will of course be understood that the pair of die compression cylinders 452 on the opposite sides of the machine are coaxially aligned with one another.

The outboard cylinders 450 and die compression cylinder 452 are operated in the sequence shown in FIGS. 43 and 44. Thus, the outboard cylinders 450 are first energized to move the mounting plate 430 to the indicated intermediate position while the die compression cylinder 452 remains retracted. Upon subsequent admission of compressed air into the die compression cylinder 452 its piston 472 is thrust outwardly to force the yoke assembly 400 and mounting plate 430 inwardly towards the body blank B an additional increment represented by the travel stroke range indicated in FIG. 44. When all of the cylinders 450, 452 are vented to atmosphere the pair of springs 446 effect retraction of the yoke assembly 400 and mounting plate 430 to the retracted position indicated in FIG. 40.

Reverting to FIG. 28, the vertical lift plate assembly 404 is mounted on the center of the die plate 430 and at its lower end supports the means 406 which includes the body blank support, guide, folding and die plate mechanisms. In general, the arrangement is such that when the means 406 is elevated relative to the mounting plate 430 to lift a blank B, a cam link means interposed between the two also translates the relative movement into articulation of some elements of the means 406 to fold the body blank areas $B_s$ through 90° relative to the bottom panel area $B_b$.

As is shown in FIG. 45, the vertical lift assembly 404 includes a vertically disposed guide plate 480 having its upper end rigidly fastened, as by fastener means 482, to the central portion of the mounting plate 430. In that portion of the guide plate 480 which projects downwardly beyond the lower edge of the mounting plate 430, a closed end longitudinally extending central guide slot 484 is formed between lubricant tapes 485. A vertically extending side plate 486 slidably overlies the guide plate 480 and is fastened, through the slot 484, to a horizontally extending lift beam 488. The horizontal lift beam 488 comprises a portion of the means 406. A cam linkage means 500 (FIGS. 47–53) is interconnected between the fixed die mounting plate 430 and the horizontal lift beam 488 to translate relative movement therebetween into articulating folding and unfolding movement of die plate elements carried by the beam 488.

The lift plate 486 and horizontal cross-beam 488 are disposed on opposite sides of the guide plate 480 and are interconnected, in part, through a vertically elongate spacer 502 that is slidable within the slot 484. A lubricated gib 504 is interposed between the backside of the spacer 502 and the front of the lift beam 488. A locating key 506 is interposed between the gib 504 and the lift beam 488, both of which elements are provided with appropriate recesses for seating the key 506 therebetween. A clamping plate 508 is provided on the backside of the assembly. At vertically spaced apart points along its longitudinal center line, the lift plate 486 is fitted with lubricated guide bearing means 510 having rolling contact with the side walls of the vertically extending slot 484 of the guide plate 480. As is shown in FIG. 46, the member serving as the axle for the lower one of the roller bearing means 510 also serves as a clamping fastener means for the assembly.

A pair of fastener means 512 serve to interconnect the slide plate 486, spacer 502, and gib 504 and, also, serve as a means for supporting a central horizontal die plate 514, a spacer 518, and a spring loaded center support shoe 516 on the front side of the slide plate 486. Thus, the fastener means 512 also pass through the horizontal die plate 514 and spacer 518 while the faying surfaces between the spacer 518, the horizontal die plate 514, and the slide plate 486 are provided with appropriate recesses for a pair of locating keys 520 on opposite sides of the spacer 518.

An angle bracket 522 is secured by appropriate fasteners along the underside of the horizontal die plate 514. This bracket includes a horizontally downwardly projecting leg 524 which along one vertical edge has a guide sleeve 526 rigidly secured thereto in order to axially slidably support a vertically reciprocable rod 528 to whose upper end the horizontally disposed support shoe 516 is secured. A spring 530 is interposed between the underside of the support shoe 516 and the upper end of the support tube 526. As is shown in FIG. 46, one end of the rod 528 projects downwardly beyond the lower end of its support tube 526 and has a stop collar 532 secured thereto for positively limiting upward extension of the support plate 516.

As is shown in FIG. 28, when a body blank B is in the flat indexed position, each horizontal die plate 514 serves as a support on the underside of the blank in marginal flaps $F_2$ of the blank adjacent to the bottom panel area $B_b$. It is to be understood that at this point the means 406 is then located in the previously mentioned intermediate position by the yoke means 400. The horizontal cross-beam 488 is then in its fully lowered position and at opposite end portions, flanking the horizontal die plate 514, is pivotally fitted with a pair of folding die plate mechanisms 540, 542, which are then located to serve as body blank supports. Each mechanism 540, 542 is fitted with an auxiliary means 576 to serve as a body blank edge guide. The mechanisms 540, 542 are mirror images of one another and, accordingly, but one will be described in detail.

Referring to FIGS. 47 and 48, each of the mechanisms 540, 542 includes a die plate 560 of elongate, somewhat rectangular configuration mounted so as to be swingable through substantially 90° while disposed in a vertical plane. On its backside, at one end, the die plate is fitted with a clamp bracket 562 for rigid connection to one end of a pivot shaft 564 therein, as by a key means 566. A bracket 568 slidably embraces the upper edge of one end portion of the horizontal lift-beam 488 and can be fixed in a longitudinally adjusted position relative to the lift-beam by an adjustment screw 570 in order to insure a precisely located position of the pivot axis of the upper edge of the die plate relative to a corresponding fold line of the box blank B. On its top side, the bracket 568 is fitted with a bearing 572 in which the pivot shaft 564 is rotatably seated.

When the vertical die plate 560 is in the horizontal position, its upper edge serves as a support for one of the marginal flaps $F_1$ of the blank B. The outer face of this same edge of the vertical die plate is fitted, as by means of fasteners 574, with a guide 576 which is conventionally curved at its inlet end. In order to insure a correct position of the inner face of the guide 576 relative to the edge of the blank, the pivot shaft 564 is fitted with a spacer collar 578, interposed between confronting faces of the bracket 562 and pivot shaft bearing 572.

The outer end of the pivot shaft 564 projects through and beyond the bearing 572 and is interconnected, as by key 582, to the split clamp hub of a member 584. The end of a radially extending crank arm 586 of the member 584 mounts a fastener means 588 and a roller bearing 590 oriented to project back towards the vertical plane of the die mounting plate 430 thereabove.

The just described crank arrangement comprises a portion of the cam link means 500 which has a cooperating portion mounted on the die mounting plate 430 vertically spaced above the lift beam 488 and includes an adjustable bracket generally designated at 592, in FIG. 47.

The bracket means 592 includes a vertically elongate bar 594 that is formed on its backside with a notch of a vertical dimension sufficient to straddle, with clearance, the top and bottom edges of the mounting plate 430. At its upper end the bar 594 has an opposing clamp block 596 secured thereto by a clamp screw 598. At its lower end, the vertically elongate bar 594 is formed with a vertically extending closed end slot (not shown) adapted to receive another clamping screw 600 which threadedly engages a tapped bore (FIG. 50) formed in an irregular, somewhat L-shaped bottom clamping block 602, formed with an upstanding leg 604 adapted to clamp against the backside of the mounting plate 430.

At its lower end, the clamp block 602 is formed with an offset leg 606 parallel to the bottom face of the bar 594, formed with a tapped bore (FIG. 50) to receive a vertical adjustment screw 608 to precisely locate the clamping block 604 vertically, the adjustment screw 608 being fitted with a pair of lock nuts on opposite sides of the flange 606.

On its backside, the clamping block 602 fixedly mounts a cam follower guide member 610 whose backside is formed with a pair of horizontally extending, vertically spaced apart ribs 612 defining therebetween a track for seating the roller 590.

Referring to FIG. 48, the horizontal lift beam 488 is shown in a fully lowered position relative to the horizontal mounting plate 430. The same relationship is shown in phantom outline in FIG. 49. FIG. 53 shows the operation of the cam link means 500 resulting from lifting the horizontal lift bar 488 relative to the mounting plate 430, i.e., movement of the crank arm 586 through an arc of 90° relative to the interconnection of the cam roller 590 in the track between the ribs 612. As a consequence, the corresponding vertical die plate 560 is rotated from the horizontally extending position of FIG. 48 to the vertically extending position illustrated in solid outline in FIG. 49. While in the latter position, the entire assembly will be shifted inwardly, to the die compression position previously described, to effect final folding and gluing of the marginal flaps $F_1$, $F_2$ onto the H-divider end panels $H_e$. Accordingly, the end of the die plate 560 remote from its pivot axis will be subjected to a bending moment, which may also strain the pivot shaft 564, which is opposed by providing support for the outer end of the vertical die plate 560 when in the vertical position of FIG. 49.

More specifically, the bracket means 592, at its upper end, fixedly mounts a wedge plate 616, extending along a tangent to an arc centered on the pivot shaft 564, formed with an entering guide ramp 618. The backside of the die plate 560 has a bracket 620 mounting a roller 622 that is located with respect to the axis of the pivot shaft 564 on a radius to intercept the wedge plate 616 to bear on the inner face of the wedge plate when the die plate 560 is in the upright vertically extending position of FIG. 49. Thus, upon inward movement of the entire assembly from intermediate position to the die compression position, the outer end of the die plate 560 is firmly supported to resist outward deflection.

Turning of the die plates 560 from the horizontal to the vertical positions in the manner just described effects folding of the body blank side walls $B_s$ 90° upwardly relative to the bottom $B_b$, as is shown, for example, in FIG. 34. As will presently appear, the simultaneous lifting of the vertical die plates 560 and horizontal die plate 514 with consequent 90° rotation of the die plates also effects partial inward turning of the body blank marginal flaps $F_1$ and $F_2$. When the body blank side walls $B_s$ have been turned to the fully upright position, they are firmly biased against vertical edges of the H-divider end walls $H_e$ and corresponding vertical edges of the mandrel means 70 by means of a bias fold shoe 630 carried by each vertical die plate 560.

Each bias shoe 630 is a length of a spring steel leaf that has an inner end connected to a bracket 632 that, in turn, is secured to the backside of the corresponding vertical die plate 560, by fasteners 634. The upper end of the bracket 632 is preferably formed with a slot on an arc relative to the lower fastener 634 in order to effect angular adjustment of the shoe 620 relative to its die plate 560. The outer end of each of the fold shoes 630 is curved, as indicated, for smooth non-penetrating and laterally slidable engagement with a side $B_s$ of the box blank B. The desired angular relationship of each shoe 630 relative to its die plate 560 is best illustrated by a comparison of FIGS. 37 and 38.

Referring to FIG. 38, it will be seen that when a die plate 560 is in the phantom horizontally extending position, the outer end of its shoe 630 is spaced below the bottom of the blank B. The flaps $F_1$, $F_2$ of the flat blank B are then supported on the upper edges of the vertical die plates 560 and horizontal die plate 514, while the spring loaded center support member 516 is spaced beneath the bottom surface of the blank B. At the same time, a fully formed H-divider, which may not be fully centered in the mandrel (FIG. 26), resides in the mandrel means 70 with the lower edges of the H-divider projecting slightly beneath the bottom plane of the mandrel means but in spaced relation to the blank B indexed therebelow.

As the die plates 560 commence rising from the phantom position of FIG. 38, along with the horizontal die plate 514, the vertical die plates are concurrently turned about their pivot shafts 564. During an initial increment of turning of the die plates 560, the blank B, while still flat, is lifted slightly upwardly away from the upper edge of the horizontal die plate 514 but is indexed and confined longitudinally between the stop means 92 and the vertical face of the infeed drag shoe 96 and ultimately forces the downwardly projecting edge of the H-divider upwardly into flush relationship to the bottom of the mandrel means 70. Thereafter, continued turning of the vertical die plates 560 effects folding of the body blank side wall areas $B_s$.

Because of the initial clearance between the outer ends of the bias shoe 630 and the underside of the blank B, the bias shoes do not come into biasing contact with the body blank side wall panels $B_s$ until or just before the side wall panels are in the fully erected 90° relationship relative to the bottom panel area $B_b$ as in FIG. 37. In advance of this condition, after about 45° of turning of die plates 560, the spring loaded support shoe 516 has come into engagement with the bottom side of the bottom panel area $B_b$ thereafter effecting compression of the spring 530 (as in FIG. 33), during the last 45° of turning of the plates 560.

The just described means of lifting the flat blank B and thereafter folding it relative to the fully formed H-divider during depression of spring loaded shoes 516 appears to be of critical importance and effects a kind of self-centering action of the two box components relative to one another. Thus, as in FIG. 26, an H-divider may be slightly off location horizontally and not precisely centered with respect to the indexed flat blank B therebeneath even after gluing. In this connection, it will be recalled that the movable shoes **340*a* and 344*a* of the mandrel half 70*a* are retracted after gluing is done. In the operation of the machine, it appears that by virtue of having the H-divider project slightly below the mandrel means 70**, there is an increment of upward co-movement of the H-divider and the blank B, which is then folding, during which the folding movement of the side wall areas $B_s$ acts somewhat in the manner of a V-block relative to vertical edges of the end panels $B_e$ and effects precise centering of the two components relative to one another.

In order to effect lifting of the body blank fold and die plate mechanisms 406, the machine frame 60 mounts a pair of pneumatic lift cylinders 650 on each side in the manner shown in FIG. 6. Each lift cylinder 650 is of the double acting type internally containing a piston for reciprocating a downwardly projecting piston rod 652. As is shown in FIG. 46, the lower end of the piston rod 652 is pivotally connected, as at 654, to a bracket provided on the upper end of the corresponding slide plate 486. At the upper end of its housing, the cylinder 650 is fitted with a bracket providing pivotal connection means 656 that, in turn, has an adjustable screw threaded connection, indicated at 658, with the horizontal flange of the bracket member 120. This pivotal mounting for the opposite ends of the lift cylinder 650 accomodates movement of the body blank fold and die plate mechanisms 406 between the previously described intermediate, die compression, and retracted positions.

It will be understood that the lift cylinders 650 have a stroke range such as is indicated, for example, for the horizontal lift beam 488 in FIG. 33. As a means of synchronizing the cycle of operation of the lift cylinders 650 with movement of the vertical die plates 650 and horizontal die plate 514 from intermediate to die compression position, a valve control switch 664 is mounted in operative association with one of the lift cylinders.

More particularly, as is shown in FIG. 6, the switch 664 is secured to the body of the lift cylinder 650 and has an L-shaped switch arm 666 having a portion in interfering alignment with an actuator 668 connected to the lower end of the piston rod 652. The arrangement is such that when the piston of the cylinder 650 has been fully raised, the switch arm 666 is deflected to energize the switch 664 to operate valves arranged to communicate compressed air with the die compression cylinders 452 in a manner such that both body blank fold and die plate means 406 are moved inwardly towards one another to the die compression position, effecting final folding and gluing of the marginal flaps $F_1$, $F_2$ of the body blank B on the preformed H-divider.

FIG. 54 shows an electromechanical control system for the machine of the invention in conjunction with a pneumatic power circuit for actuating the several pneumatic H-blank and body blank mechanisms.

A souce of compressed air is connected to a conduit means 670 that communicates with the H-fold cylinder 264, vertical lift cylinders 650, mandrel shoe cylinders 352, outboard cylinders 450, die compression cylinders 452, H-blank kicker cylinder 80 and body blank kicker cylinder 82.

The H-kicker cylinder 80 is of the double acting type having opposite end ports 674 and 676 either of which may be communicated with the source of compressed air under the control of a double solenoid valve 678. As will be apparent, when the port 676 is communicated to the source of compressed air, one of the blanks H is fed out of the upper supply hopper and feed means 62. When the other port 674 is connected to the source of compressed air, upon operation of the valve 678, the kicker cylinder retracts in readiness for delivery of the next H-blank.

In similar fashion, the body blank kicker cylinder 82 has ports 672 and 680 at opposite ends, either of which can be connected to the source of compressed air under the control of a single solenoid valve 682, such that communication of the port 672 with the source of compressed air effects delivery of a body blank B while communication of the other port 680 with the source of compressed air effects retraction of the kicker cylinder in readiness for delivery of the next body blank B.

The opposite end ports 296 and 294 of the H-fold cylinder 264 are alternately communicated with the source of compressed air under the control of a double solenoid valve 684, to vertically reciprocate the H-feed fingers 200 in the manner previously described.

All of the air loaded mandrel shoe cylinders 352 are controlled by one double solenoid valve 686 having one port 688 for communicating the cylinders 352 with the source of compressed air, and another port 690 for venting the cylinders 352 to atmosphere.

Both of the vertical lift cylinders 650 have opposite end ports which are alternately connected to the source of compressed air under the control of a double solenoid valve 692 having a port 694 communicating with upper ends of the lift cylinders to effect lowering of the vertical slide plates 486 and, therefore, of the body blank fold and die plate mechanisms, and another port 696 to effect raising of the vertical slide plates 486.

The four outboard cylinders 450 for the pair of die mounting plates 430 are all connected to one double solenoid valve 700 having a port 702 for effecting communication of the outboard cylinders with the source of compressed air and a port 704 for venting the outboard cylinders 450 to atmosphere. In similar fashion, both die compression cylinders 452 are interconnected to a double solenoid valve 706 having a port 708 for connecting the cylinders 452 to the source of compressed air and another port 710 for alternately communicating the cylinders 452 to atmosphere.

The double solenoid valves 678, 684, 686, 692, 700, and 706 mentioned above have obturating members, e.g., spools, which remain in their last energized position when neither solenoid is energized. The single solenoid valve 682 has an obturating member normally biased to one position to which the member returns when the corresponding solenoid is de-energized.

Referring to FIGS. 54 and 55, the electrical control circuit includes a selector switch 712 which can be closed to a hand position or to an automatic position. Assuming a circuit master switch (not shown) to be closed, when the switch 712 is closed in either position it is electrically connected, at terminal **712*a*, to normally closed contacts 713 on one side of a body blank present switch 716 to energize the solenoid 718 of the H-kicker cylinder control valve 678. As a result, compressed air is admitted through the port 676 of the H-kicker cylinder 80 to deliver a single H-divider blank H, to indexed position. Another hand position terminal 712*b* permits others of the several control switches to be manually operated through isolated circuits (not shown). Thus, the hand position of the selector switch 712** provides a means of setting up or adjusting the machine with trial runs of particular sizes of blanks H and B.

To initiate automatic operation the selector switch 712 is moved to the automatic position. As in the hand position, the normally closed contacts 713 of the body blank present switch 716 energize the solenoid 718 of the H-kicker cylinder control valve to deliver a single H-divider blank H.

As the blank H moves in the direction of the H-blank stop switch 182, it actuates an H-blank sensor switch 720 that is electrically connected to a glue system for the upper H-blank hopper and feed system, which is preset to deliver the pattern of glue stripes $G_h$-1 and $G_h$-2 of FIG. 2. The glue systems per se form no part of the present invention. For present purposes, suffice it to say that a variety of glue systems are available for the purpose.

The H-blank stop switch 182 has its control arm 184 normally biased into a position for maintaining two pairs of contacts 722, 723 in a normally open condition. It will be recalled that when the blank H engages the stop switch 182 its end wall areas $H_e$ have been bent downwardly 90° in the manner previously described and as shown in FIGS. 8–12.

Contact of the leading edge of the H-blank momentarily effects depression of the switch arm 184 to effect closing of the normally open contacts 722, 723. Closing of the contacts 722 simultaneously effects actuation of the pneumatic cylinder 264 and corresponding downward movement of the fingers 200; retraction of the pistons of the outboard cylinders 450 and die compression cylinders 452 for spring biased movement of both of the pair of die mounting plates 430 to the retracted position indicated in dotted outline in FIG. 54; and downward movement of the piston rods of the lift cylinders 650 with corresponding downward movement to the lowered position of the slide plates. Closing of the contacts 723 energizes the holding relay 732.

More particularly, closing of the contacts 722 of the H-divider limit switch 182 effects energization of one solenoid 724 of the H-fold cylinder control valve 684 so that compressed air is admitted through the port 294 to effect upward extension of the piston driven rack 268 and downward driving of the vertically extending racks 204 through the previously described gear train. As a result, the pair of fingers 200, bearing on opposite ends of the transverse fold line 76 of the blank H, drive the H-divider blank downwardly to effect folding against one another of the vertical panel areas $H_v$. From the prior cycle of machine operation, the air loaded shoe cylinders 352 of the mandrel means 70 are now in the retracted position. As the folding H-blank enters the mandrel means 70 the previously made container C is ejected therefrom.

Closing of the contacts 722 of the H-divider stop switch 182 also effects electrical energization of one solenoid 726 of the outboard cylinder control valve 700 and one solenoid 728 of the die cylinder control valve 706. Energization of the solenoids 726 and 728 thus sets the valves 700 and 706, respectively, in a mode to effect venting of the outboard cylinders 450 and die cylinders 452 to atmosphere. Thereupon, the spring biased die mounting plates 430 are retracted outwardly to the fully retracted position to provide clearance through the body blank folding and die means for ejection of a container having marginal flaps $F_4$ on the cover flap areas $B_c$-1 and $B_c$-2.

Closing of the contacts 722 of the H-blank stop switch 182 effects energization of one solenoid 730 of the lift cylinder control valve 692 to set the valve in a mode to deliver compressed air to the upper ends of the lift cylinders 650 with consequent lowering of the vertical slide plates 486.

The H-stop switch 182 is closed momentarily and returns to normally open condition as the fingers 200 pull the H-blank down out of contact with the switch arm 182. However, closing of the contacts 723 of H-stop switch 182, connected in series with normally closed contacts 714 of the body blank switch 390, energizes relay 732 and also starts body blank timer 734. The relay 732 thus closes its normally open contacts (8, 6) through which it backfeeds to the body blank timer 734 and kicker 742 and remains energized after the H-blank has left the switch arm 184.

Before the body blank timer 734 times out the H-fold gear rack 268 contacts its switch 300 whereupon the switch closes to energize another solenoid 736 of the control valve 684 for the H-cylinder 264. The switch 300 is positioned so that it closes when the lower edge of the erected H-divider projects slightly below the bottom of the mandrel means 70, as previously described. When the solenoid 736 is energized, the valve 684 now assumes a mode in which the port 296 of the cylinder 264 is communicated with the source of compressed air to effect retraction of the rack 268 with consequent upward retraction of the vertical racks 204 and fingers 200.

Closing of the switch 300 also effects energization of a solenoid 740 of the air loaded mandrel shoe control valve 686 thus setting the valve in a mode to interconnect all of the air loaded shoe cylinders 352 to the source of compressed air to effect compression between the split halves of the mandrel means 70 and glue bonding between the vertical panel areas $H_v$.

Closing of the switch 300 also effects energization of the other solenoid 742 of the outboard cylinder control valve 700, setting the valve in a mode to connect the outboard cylinders 450 to the source of compressed air. As a result, the lowered pair of die mounting plates 430 and, consequently, the body blank folding and die means, are set into the intermediate position required for a confined running surface of the body blank B to indexed position as shown in FIG. 28.

At this point, the body blank timer 734 times out and momentarily engages the single solenoid 742 of the body blank kicker cylinder control valve 682. The valve 682 is then set in a mode to operate the kicker cylinder 672 to deliver a body blank B towards the body blank stop switch 390.

After leaving the supply hopper the body blank B first passes in operative association with the body blank present switch 716 which is thereby actuated to close a normally open pair of contacts 715 to effect energization of the other solenoid 719 of the control valve 678 for the H-kicker cylinder 80 effecting retraction of the H-kicker to a position in readiness for delivering another H-blank. Next, the body blank B passes in operative association with a glue system control sensor switch 746 whereby the desired pattern of glue stripes $G_b$ is delivered onto the flaps $F_1$ and $F_2$ of the body blank. Up to this point, the holding relay 732 has been back feeding through internal contacts to maintain current to the body blank timer 734 and body blank kicker valve solenoid 742.

As the trailing edge of a body blank B leaves the body blank present switch 716 the switch 716 returns to normally closed condition closing the contact 713 whereby a new H-blank is delivered prior to completion of the present ongoing cycle of box formation.

The body blank limit switch 390 has a switch arm 392 normally biased to a position for maintaining contacts 714 on one side in a normally closed condition. When the switch arm 392 of the body blank limit switch 390 is depressed by the leading edge of the body blank it closes pairs of normally open contacts 746, 748 on the other side of the switch and effects the following functions: raising of the vertical slide plates 486 (with consequent articulation of elements of the body blank folding and die mechanism); retraction of the air loaded shoes 344*a* and 40*a*; and unlatching of the relay 732 by opening the normally closed contacts 714 of the body blank switch 390.

Closing of the normally open contacts 746 of the body blank limit switch 390 effects energization of the other solenoid 750 of the air loaded shoe control valve 686. As a result, the valve is set in the condition to communicate each of the shoe cylinders 352 to atmosphere. Accordingly, the air loaded shoes 344*a* and 340*a* are in the retracted position shown in solid outline leaving the erected H-blank suspended in the mandrel relative loosely to effect self-centering engagement with the upcoming body blank.

Closing of the normally open contacts 748 of the body blank limit switch 390 also effects energization of the other solenoid 752 of the lift cylinder control valve 692. Consequently, compressed air is communicated to the underside of the pistons of the lift cylinders 650 effecting lifting of the vertical slide plates 486.

When the vertical slide plates 486 have been lifted sufficiently to lift the body blank into contact with the bottom face of the mandrel means 70 and effect 90° folding of the side wall panels, the switch arm 666 of the limit switch 664 is actuated to close internal normally open contacts for energizing the other solenoid 754 of the die cylinder control valve 706. The valve is then set in a mode for extension of the piston rods of the die cylinders 452 to effect final inward folding and compression of the marginal flaps $F_1$ and $F_2$ of the body blank B into adherent adhesive contact with the end wall portions $H_e$ to complete the carton C. When the next H blank contacts the H-stop switch 182, the die compression cylinders 452 are retracted (among other things) leaving the completed container C in a relatively loose position ready for discharge from the mandrel means 70.

In the manufacture of the blank H, it should be understood that all cuts and scores are made on one side only, usually the top side. The slit and scored blank is then inverted to the attitude shown in FIG. 2*a* wherein that liner which has been slit, e.g., at $S_s$-1, faces downwardly when the blank is placed in the high hopper 62. As is shown in FIG. 2, the infeed direction of a blank H is at 90° to the hinge 76.

Similarly, the blank B is formed with the scores on one side only and preferably is placed in the low hopper and feed means 64 with the score side up.

As has been noted with reference to FIG. 22, the clearance space between the inside surface of a vertically extending guide tube 116 and the vertical plane of the outside surface of the corresponding mandrel side plate 322 is greater than the thickness of the box material, i.e., the indicated width of the end panel $H_e$. As is also shown in FIGS. 21 and 22, the upper end of each spring rod 380 is convergently inclined relative to the corresponding vertical face of the mandrel. With this arrangement, it will be understood that when a fully indexed blank H, as shown in the solid outline position of FIG. 19, arrives in the indexed position, its end panels $H_e$ have been folded to slightly less than 90° and by virtue of their spring back relative to the score line $P_s$-1 are biased into engagement with the inner confronting surfaces of the guide tubes 116. At the same time, the blank H is precisely laterally indexed by the outer edges of the upper horizontal faces of the guide shoes 160. Then, as the blank H is fed downwardly by the feed fingers 200, the spring guide rods 380 effect the final increment of turning of the end flaps $H_e$ through 90° into firm contact with the mandrel sides 322. In this connection, it should also be noted that the spring guide fingers 380 also serve as friction brakes to hold the fully erected H-divider in the desired position projecting slightly beneath the bottom horizontal plane of the mandrel means 70, as indicated in FIG. 19.

Special note should also be taken of the mode of operation of the body blank fold and die plate means 72 which appears to be of critical importance in the successful formation of an H-divider container C. Thus, referring to FIGS. 27 and 28, when the body blank fold and die plate means 72 are in the lowered intermediate position, a blank B is laterally indexed by the edge guides 576 and longitudinally indexed between the stop means 92 and the vertical flange of the overhead drag shoe 96. The indexed flat blank B, prior to any lifting, is then supported at its marginal flaps $F_1$ and $F_2$ by the upper horizontal edges of the die plates 540 and central horizontal die member 514, respectively. At the same time, as is shown in FIG. 32, the spring loaded support shoe 516 is then spaced beneath the panel $B_b$ of the blank B.

Upon lifting of the pair of body blank fold and die plate means 72, the die plates 540 immediately commence rotation from their horizontal positions towards vertical positions. Opposite ends of each pair of die plates 540 thus lift the blank B, which is still flat, out of contact with the upper horizontal edge of the horizontal die member 514. The blank B, while remaining flat, is thus lifted, first, into contact with the lower protruding edge of the erected H-divider and then comes into flush contact with the lower horizontal face of the mandrel means 70. At about this point, each of the spring loaded support shoes 516 comes into engagement with the underside of the panel $B_b$. Continued lifting of the pair of body blank fold and die plate means 72 causes overtravel of the horizontal die members 514 relative to the spring loaded shoes 516, which forcefully spring biases the bottom $B_b$ of the body blank against the bottom of the mandrel. At the same time, such overtravel effects final rotation of the vertical die shoes 560° to 90° positions and the bias shoes 630 come into play. In effect there is a forceful slapping of the panels $B_s$ of the body blank against the vertical edges of the end panels $H_e$. In this connection, the spring loaded support shoes 516 appear to be of great importance in permitting the self-centering action of the erected H-divider relative to the upcoming body blank B during upward turning of the vertical die plates 560. Also, during this folding operation, the spring guide rods 380 again act as friction brakes to maintain contact between the erected H-divider and the upcoming and folding body blank B during the self-centering action.

While the invention has been disclosed and described in connection with preferred embodiments of the H-blank, H-divider container, process, and machine, it will be appreciated by those skilled in the art that the invention is not limited to the disclosed embodiments but is susceptible of being carried into effect by other embodiments.

I claim:

1. A method of forming an H-divider container from a preformed flat H-divider blank and a preformed flat body blank, the flat H-blank, comprising a paperboard sheet having a layer sandwiched between a pair of liners, having a pair of divider panels joined together along a preformed hinge line, the hinge line comprising a score length leaving the top liner intact at least in part, the flat H-blank further having each divider panel transversely flanked by an integral pair of foldable end wall panels, the flat body blank comprising a substantially rectangular bottom panel joined, along a longitudinally spaced apart pair of parallel transverse fold lines, to an opposite pair of side panels, each of the side panels having a transversely opposite pair of foldable marginal flaps, said method comprising the steps of:

folding the end wall panels of the flat H-blank substantially 90° towards that side of the H-blank having the bottom liner, while maintaining the divider panels in a common plane;

while maintaining the end wall panels in said substantially 90° folded condition, erecting the H-divider by folding the divider panels along the hinge line out of said common plane and into mutual contact of the top liners of the divider panels;

moving the body blank bottom panel into mutual contact with lower edges of the erected H-divider;

folding the side panels of the body blank substantially 90° upward relative to the bottom panel and into contact with vertical edges of the end wall panels of the erected H-divider;

and folding the marginal flaps of the body blank through 90° into contact with vertical edge portions of the end wall panels of the erected H-divider.

2. The method of claim 1 wherein folding of the divider panels along the transverse hinge line into mutual contact of their top liners is by means of applying a force against an intact portion of the top liner of the H-blank along the hinge line.

3. The method of claim 2 wherein the force is simultaneously applied at both of the opposite end portions of the hinge line.

4. The method of claim 1 further characterized in that, prior to the step of erecting the H-divider, adhesive is applied to the top liner of one of the divider panels and further characterized in, after erecting the H-divider, pressing the erected divider panels against one another for effecting adhesive bonding therebetween.

5. The method of claim 1 further characterized in that, prior to the step of moving the body blank into contact of the bottom panel with the lower edges of the erected H-divider, the flat body blank is placed in an indexed position in spaced relation to the erected H-divider with edges of the bottom panel of the body blank in registration with the rectangular area included by the erected H-divider and, thereafter, moving the body blank into said contact by means of force applied to marginal flaps of the body blank.

6. The method of claim 1 wherein folding the side panels of the body blank upwardly relative to the bottom panel is by means of force applied to the marginal flaps of the side panels to effect partial folding of the marginal flaps of the side panels relative to the vertical edges of the end panels of the erected H-divider.

7. The method of claim 1 including the step of centering the erected H-divider relative to the bottom blank body panel by yieldably restraining the erected H-divider against movement in response to the step of folding the side panels of the body blank into contact with vertical edges of the end wall panels of the erected H-divider.

8. The method of forming a divider from a preformed divider blank comprising a paperboard sheet having a layer sandwiched between a pair of liners, the blank having a pair of divider panels joined together along a hinge line comprising a score length leaving the top liner intact at least in part, said method including:

applying a force against an intact portion of the hinge line top liner while opposing said force on the bottom liner on opposite sides of the hinge line to fold the panels into mutual contact of their top liners.

* * * * *